US012427384B2

(12) United States Patent
Spackman et al.

(10) Patent No.: US 12,427,384 B2
(45) Date of Patent: Sep. 30, 2025

(54) MALLET-STYLE PUTTER HEAD WITH ALIGNMENT AID

(71) Applicant: KARSTEN MANUFACTURING CORPORATION, Phoenix, AZ (US)

(72) Inventors: Clayson C. Spackman, Scottsdale, AZ (US); David A. Higdon, Cave Creek, AZ (US); Paul D. Wood, Phoenix, AZ (US); Jemma Brown, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 33 days.

(21) Appl. No.: 18/180,767

(22) Filed: Mar. 8, 2023

(65) Prior Publication Data

US 2023/0302334 A1 Sep. 28, 2023

Related U.S. Application Data

(60) Provisional application No. 63/269,030, filed on Mar. 8, 2022.

(51) Int. Cl.
*A63B 53/04* (2015.01)
*A63B 53/00* (2015.01)

(52) U.S. Cl.
CPC ..... *A63B 53/0487* (2013.01); *A63B 53/007* (2013.01); *A63B 53/0408* (2020.08); *A63B 53/0441* (2020.08)

(58) Field of Classification Search
CPC ..... A63B 53/0487; A63B 53/0408; A63B 53/0441; A63B 53/007
(Continued)

(56) References Cited

U.S. PATENT DOCUMENTS 2,859,972 A * 11/1958 Reach ..... A63B 60/00 473/242
4,157,830 A * 6/1979 Taylor ..... A63B 69/3632 473/314

(Continued)

FOREIGN PATENT DOCUMENTS

WO WO-2016123255 A1 * 8/2016 ..... A63B 53/007

OTHER PUBLICATIONS

Original and translation of Document ID: DE-20100709-U1; titled "Golf club head", with an inventor name: Schirrmeister; pp. 1-25; published Jun. 28, 2001. (Year: 2001).*

(Continued)

*Primary Examiner* — Sebastiano Passaniti

(57) ABSTRACT

Embodiments of mallet-style putter-type golf club heads comprising a first color and an alignment system to draw a golfer's eye towards a particular desirable location are described herein. The alignment system includes a central line extending rearward from a top edge centerpoint toward the rear portion and comprising a second color different from the first color. The alignment system further includes a focus element having a first grouping of lines and a second grouping of lines each extending rearward parallel to the central line and comprising a base abutting a top edge. Each of the first grouping of lines and the second grouping of lines further comprise at least the second color, a color saturation that changes as the lines extend rearward from the top edge, and line lengths that decrease as the first grouping of lines and the second grouping of lines are distributed further from the central line. The alignment system's changes in color, color saturation, and line length provide means to draw the human eye into focus at a particular desirable location to minimize mis-strokes that would cause undesirable variance from the desired trajectory or roll path.

15 Claims, 9 Drawing Sheets
(6 of 9 Drawing Sheet(s) Filed in Color)

(58) Field of Classification Search
USPC ..... 473/238, 251, 252, 313, 340
See application file for complete search history.

(56) References Cited

U.S. PATENT DOCUMENTS

| | | | | |
|---|---|---|---|---|
| 5,676,603 | A | 10/1997 | Miller | |
| 5,984,800 | A * | 11/1999 | Uebelhor | A63B 53/0487 473/340 |
| 8,246,481 | B2 | 8/2012 | Stites | |
| 8,696,483 | B2 * | 4/2014 | Hilton | A63B 69/3685 473/340 |
| 9,656,132 | B2 * | 5/2017 | Flaherty | A63B 69/3632 |
| 9,962,582 | B2 * | 5/2018 | Antku | A63B 53/0466 |
| 10,398,949 | B2 * | 9/2019 | Hayashi | A63B 53/0466 |
| 10,814,190 | B2 * | 10/2020 | Beach | A63B 53/04 |
| 11,813,508 | B2 * | 11/2023 | Higdon | A63B 53/0437 |
| 2002/0006833 | A1 * | 1/2002 | Mason | A63B 53/04 473/328 |
| 2004/0219987 | A1 * | 11/2004 | Scott | A63B 69/3688 473/270 |
| 2006/0014590 | A1 * | 1/2006 | Tao | A63B 53/0487 473/340 |
| 2007/0259735 | A1 * | 11/2007 | Beckman | A63B 53/0487 473/340 |
| 2009/0017933 | A1 | 1/2009 | Stites | |
| 2009/0017934 | A1 | 1/2009 | Stites | |
| 2010/0304878 | A1 | 12/2010 | Reichow | |
| 2012/0094782 | A1 * | 4/2012 | Beach | A63B 60/00 473/340 |
| 2016/0220875 | A1 * | 8/2016 | Sanyal | A63B 53/065 |
| 2017/0036078 | A1 * | 2/2017 | Serrano | A63B 53/0487 |
| 2021/0146200 | A1 * | 5/2021 | Heylmun | A63B 53/04 |

OTHER PUBLICATIONS

Original and translation of Document ID JP-H09262323-A; titled "Golf Club", with an inventor name: Oku Yutaka; pp. 1-13, published Jul. 10, 1997. (Year: 1997).*

* cited by examiner

MALLET-STYLE PUTTER HEAD WITH ALIGNMENT AID

CROSS REFERENCE PRIORITIES

This claims the benefit of U.S. Provisional Application No. 63/269,030, filed Mar. 8, 2022, the contents of which are fully incorporated herein by reference.

TECHNICAL FIELD

This disclosure relates generally to golf clubs and relates more particularly to mallet style putter type golf club head having a plurality of focus elements configured to draw the eye adjacent the ball.

BACKGROUND

The three main types of putter styles include mallet style putters, blade style putters, and hybrid putters (between mallet and blade). In comparison, the blade style putter is much thinner (in a face to rear direction) than the mallet style putter. Blade style putters have comprised relatively the same shape throughout the years while the mallet style putter has evolved from the original half circle design, to include a variety of shapes and sizes. In most situations, the weight of a blade style putter is greater than its mallet counterpart. However, in most situations the physical size of a mallet style putter is larger than a blade style putter. The larger size of the mallet style putter allows for a higher moment of inertia (MOI), which translates into allowing the mallet style putter to be more forgiving. However, the thin shape of blade putters helps to keep the eye from roaming away from the ball at address, better focusing the player on the ball. A mallet putter, in contrast, has a larger shape that can distract the user's eyes by drawing the gaze towards the rear of the mallet, away from the ball.

The quiet eye phenomenon is defined as the final fixation or tracking gaze at a task-relevant location prior to the initiation of the final phase of movement. The initiation of the final phase of movement for a putting stroke is back-stroke pulling the putter head away from the ball prior to the forward stroke to strike the golf ball. Studies have found high levels of performance (i.e., putting well) occur when a person's focus, or eye, lingers on a the ball before and during the putter and then fixates at the point of contact. In golf, this translates to focusing on the ball at the time of address and throughout the entirety of the putting stroke.

An alignment system on the crown can be employed to draw the eye to a point adjacent the strike face, focusing the user on a position adjacent the ball. This alignment system can prevent distraction, encourage focus on the ball, and utilize the quiet eye phenomenon while maintaining the mass property benefits of a mallet-style putter head. The mallet-style putter as described herein draws the eye to the center front of the crown. At address, this position is directly adjacent to the ball. This allows the user to reap the mass property benefits of a mallet-style putter head while maintaining focus throughout the swing. Therefore, there is a need in the art for a mallet-style putter head comprising an alignment aid on the crown configured to draw the eye adjacent the ball.

BRIEF DESCRIPTION OF THE DRAWING

The patent or application file contains at least one drawing executed in color. Copies of this patent or patent application publication with color drawing(s) will be provided by the Office upon request and payment of the necessary fee.

To facilitate further description of the embodiments, the following drawings are provided in which:

FIG. 2 further illustrates an alignment system including a triangularly dispersed line series featuring saturation gradients of both blue and white as well as a central line in white and a central dot in red.

FIG. 3 further illustrates an alignment system including a triangularly dispersed line series and central line in white as well as a central dot in red.

FIG. 4 further illustrates an alignment system including a triangularly dispersed line series with a variation in saturation and a central line in white.

FIG. 5 further illustrates an alignment system including a triangularly dispersed line series with a variation in saturation and a non-continuous central line in white.

FIG. 6 further illustrates an alignment system including a triangularly dispersed line series featuring saturation gradients of both blue and white as well as a central line in white.

FIG. 7 further illustrates an alignment system including a triangularly dispersed line series featuring saturation gradients of both blue and white as well as auxiliary lines in white.

FIG. 8 further illustrates an alignment system including a triangularly dispersed line series featuring saturation gradients of both blue and white as well as a central line in gray.

FIG. 9 further illustrates an alignment system including a triangularly dispersed line series featuring saturation gradients in blue along a top rail and a central line in white.

FIG. 10 further illustrates an alignment system including a triangularly dispersed line series featuring saturation gradients in blue and a central line in white.

FIG. 11 further illustrates an alignment system including a triangularly dispersed line series featuring saturation gradients in white as well as a central and auxiliary lines in white.

Figure 1:
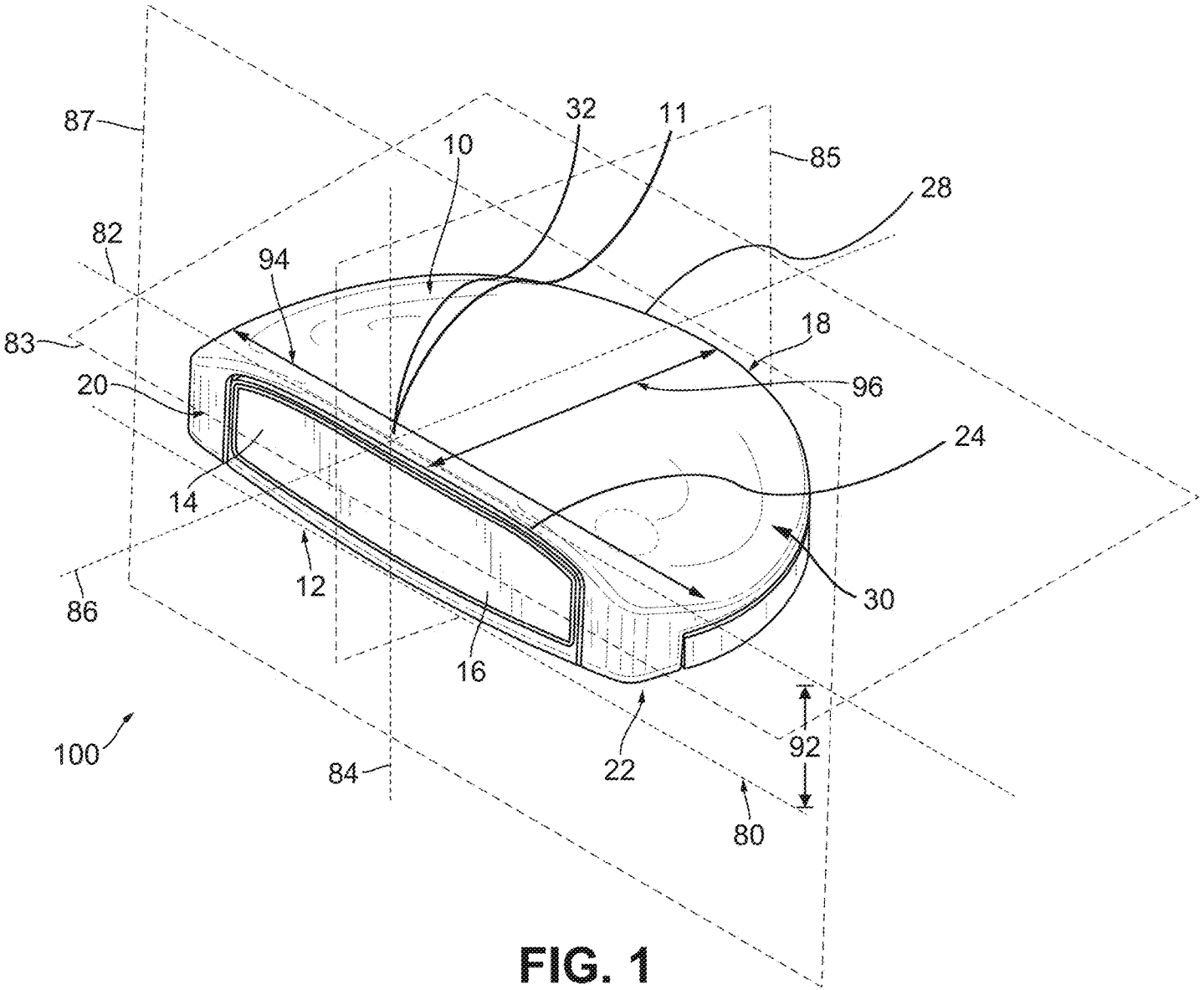
FIG. 1 illustrates a perspective view of a mallet-style golf club head.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

Various patterns or shapes within the figures may represent color or color variant not otherwise depicted. The first color as described herein may be represented by a solid, unmarked white. The second color as described herein may be represented by a plurality of dots in descending frequency to illustrate a demarcation in tone from the first color as well as any saturation shift. The third color as described herein may be represented by a plurality of squares in descending frequency to similarly illustrate a demarcation in tone from the first or second color as well as any saturation shift. The first and second color are not necessarily confined to the examples presented herein.

An alignment system on a putter helps a golfer orient the putter head to the desired stroke path for the golf ball. The alignment system may comprise one or more focus elements that contribute to the alignment of the putter head, and also draw the golfer's eyes toward the crown's top edge adjacent to the golf ball. The one or more focus elements help the golfer's eye to remain fixed on the golf ball to minimize mis-strokes that would cause undesirable variance from the desired trajectory or roll path. The focus elements can take a variety of forms, such as front to rear lines, color patterns, variations in crown shape, and others described herein. The focus elements can also have anomalous characteristics, to further draw the golfer's eyes to a particular location. Described herein are embodiments of putter head alignment systems having focus elements.

Definitions

The terms "include," and "have," and any variations thereof, are described herein to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The term "mallet" as described herein, refers to a putter type golf club head comprising a high MOI and a minimum front to back length of 2.0 inches. The mallet putter type golf club head is typically larger than a blade style putter. The larger size of the mallet style putter allows for a higher moment of inertia (MOI), which allows the mallet style putter to be more forgiving.

The term "hybrid mallet" as described herein, refers to a putter type golf club head that is a in between a traditional mallet style golf club head and a traditional blade style golf club head. The hybrid mallet can comprise a crown, typically associated with a traditional mallet style putter, in combination with a top rail, typically associated with a traditional blade style putter.

The term "strike face," as described herein, refers to a club head front surface that is configured to strike a golf ball. The term strike face can be used interchangeably with the term "face."

The term "strike face perimeter," as described herein, can refer to an edge of the strikeface. The strike face perimeter can be located along an outer edge of the strike face where the curvature deviates from a bulge and/or roll of the strikeface.

The term "geometric centerpoint," "strike face center", or "geometric center" of the strike face, as described herein, can refer to a geometric centerpoint of the strike face perimeter, and at a midpoint of the face height of the strike face. In the same or other examples, the geometric centerpoint also can be centered with respect to an engineered impact zone, which can be defined by a region of grooves on the strike face. As another approach, the geometric centerpoint of the strike face can be located in accordance with the definition of a golf governing body such as the United States Golf Association (USGA).

The term "ground plane," as described herein, can refer to a reference plane associated with the surface on which a golf ball is placed. The ground plane can be a horizontal plane tangent to the sole at an address position.

The term "loft plane," as described herein, can refer to a reference plane that is tangent to the geometric center point of the strike face.

The term "loft angle," as described herein, can refer to an angle measured between the loft plane and the XY plane (defined below).

The term "lie angle," as described herein, can refer to an angle between a hosel axis, extending through the hosel, and the ground plane. The lie angle is measured from a front view.

The term "toe-ward," as described herein, refers to a direction extending substantially toward the club head toe.

The term "heel-ward," as described herein, refers to a direction extending substantially toward the club head heel.

The term "forward," as described herein, refers to a direction extending substantially toward the club head face.

The term "rearward," as described herein, refers to a direction extending substantially toward the club head rear.

The "length" of the club head, as described herein, can be defined as a front-to-rear dimension of the club head.

The "height" of the club head, as described herein, can be defined as a top rail or crown to sole dimension of the club head. In many embodiments, the height of the club head can be measured according to a golf governing body such as the United States Golf Association (USGA).

The "width" of the club head, as described herein, can be defined as a heel-to-toe dimension of the putter-type club head. In many embodiments, the length of the club head can be measured according to a golf governing body such as the United States Golf Association (USGA).

The "face height" of the club head, as described herein, can be defined as a height measured parallel to the loft plane between a top end of the strike face perimeter near the top rail or crown and a bottom end of the strike face perimeter near the sole.

The "leading edge" of the club head, as described herein, can be identified as the most sole-ward portion of the strike face perimeter.

The term "face height" of the putter-type club head, as described herein, can be defined as a height measured parallel to the loft plane between a top end of the strike face perimeter near the top rail or crown and a bottom end of the strike face perimeter near the sole.

The term "address position" or "at address position" as described herein, can be defined as the placement of a golf club comprising a golf club head or putter head on the ground such that the golf club head is aligned as desired with the golf ball prior to the golf stroke, wherein the sole is approximately parallel to the ground plane and the crown is visible to the golfer.

The term "low saturation" as described herein, can be defined on a gradient scale of gray being 0% saturation and pure color being 100% saturation, wherein "low saturation" is a range of tones having a percent value from 0-33% pure color.

The term "medium saturation" as described herein, can be defined on a gradient scale of gray being 0% saturation and pure color being 100% saturation, wherein "low saturation" is a range of tones having a percent value from 33-66% pure color.

The term "high saturation" as described herein, can be defined on a gradient scale of gray being 0% saturation and pure color being 100% saturation, wherein "low saturation" is a range of tones having a percent value from 66-100% pure color.

DETAILED DESCRIPTION

I. Mallet Putter-Type Club Head with Enhanced Alignment Features

Described herein is an alignment system for putters including mallet putters and hybrid mallet putter designs having a minimum front to back length of 2.0 inches. An alignment system on a putter helps a golfer orient the putter head to the desired stroke path for the golf ball. The alignment system can comprise one or more of the following features selected from the group consisting of one or more focus elements: a center line element, color variations, auxiliary lines, arrow-like shapes, dots, varying surface textures, varying surface height and other features that draw the human eye into focus upon a particular location such as the crown/face junction that is aligned with a golf ball upon putting. The focus elements comprise at least one different color than the crown color. The focus elements can also comprise an anomalous characteristic. An anomalous characteristic that can be visible change to an established pattern by color, shape, disruption of the shape, size of shape or combinations thereof. One embodiment of a focus element can comprise color saturation changes or contrasts within the individual element. Another focus element embodiment may comprise a triangularly dispersed line series positioned symmetrically about the central line.

A mallet-style putter 100 typically comprises a crown 10, a sole 12 opposite the crown 10, a front portion 14 comprising a strike face 16, a rear portion 18 opposite the strike face 16 comprising a rear edge 28, a heel portion 22 adjacent a hosel, a toe portion 20 opposite the heel portion 22, a top edge 24 defined between the strike face 16 and the crown 10, and a leading edge 26 defined between the sole 12 and the strike face 16. A mallet-style putter 100 further comprises a body 30 that extends rearward from the strike face 16. The mallet-style putter body 30 generally extends further rearward than a blade-style putter body.

The crown 10 may comprise a surface with an unbroken curvature such that the crown 10 does not have abrupt changes in height wherein a crown radius of curvature changes rapidly. The crown 10 may comprise a surface having abrupt changes in putter height 92 such that the top edge 24 formed entirely within a top rail having a maximum putter height 92, with a majority of the crown surface configured to be 0.25 inch to 1.25 inches lower in height than the top rail. The majority of the crown surface can be 0.25 inch, 0.30 inch, 0.35 inch, 0.40 inch, 0.45 inch, 0.50 inch, 0.55 inch, 0.60 inch, 0.65 inch, 0.70 inch, 0.75 inch, 0.80 inch, 0.85 inch, 0.90 inch, 0.95 inch, 1.00 inch, 1.05 inches, 1.10 inches, 1.15 inches, 1.20 inches, or 1.25 inches below the top rail height. The crown may have a crown apex 11 or highest point located at the top edge 24. The crown 10 may have a crown apex 11 or highest point located rearward of the top edge 24, but forward of the rear edge 28. The minimum putter height may be located at the rear edge 28. The minimum putter height may be located forward of the rear edge 28.

The mallet-style putter-type golf club head 100 comprises a top edge centerpoint 32 wherein the top edge centerpoint 32 is an origin of a coordinate system. An x-axis 82 is defined through the top edge centerpoint 32 parallel to a ground plane 80 in a heel to toe direction. A y-axis 84 is defined through the top edge centerpoint 32 perpendicular to the x-axis 82 in a sole to crown direction; wherein the sole 12 is oriented approximately parallel to the ground plane 80 when the putter is in an address position. A z-axis 86 through the top edge centerpoint 32 is defined perpendicular to both the x-axis 82 and the y-axis 84 in a front-to-rear direction. A yz plane 85 is defined by the y-axis 84 and the z-axis 86 such that the yz plane divides the golf club head from the front to the rear into a toeside portion and a heelside portion. A top-edge centerpoint 32 is defined by the intersection of the top edge 24 and the yz plane 85. An xz plane 83 is defined by the x-axis 82 and the z-axis 86, and an xy plane 87 is defined by the x-axis 82 and the y-axis 84.

The putter-type golf club head 100 can comprise a length 96. The length 96 as described herein can be measured in a front-to-rear direction of the putter head body 30 from the most forward point to the most rearward point. The length 96 can be measured in a direction parallel to the z-axis 86. The length 96 can range from 2.0 inches to 6.0 inches. The length 96 can be 2.0 inches, 2.1 inches, 2.2 inches, 2.3 inches, 2.4 inches, 2.5 inches, 2.6 inches, 2.7 inches, 2.8 inches, 2.9 inches, 3.0 inches, 3.1 inches, 3.2 inches, 3.3 inches, 3.4 inches, 3.5 inches, 3.6 inches, 3.7 inches, 3.8 inches, 3.9 inches, 4.0 inches, 4.1 inches, 4.2 inches, 4.3 inches, 4.4 inches, 4.5 inches, 4.6 inches, 4.7 inches, 4.8 inches, 4.9 inches, 5.0 inches, 5.1 inches, 5.2 inches, 5.3 inches, 5.4 inches, 5.5 inches, 5.6 inches, 5.7 inches, 5.8 inches, 5.9 inches, or 6.0 inches.

The mallet-style putter-type golf club head can comprise a height 92. The height 92 (of a putter type club head) as described herein can be measured in a bottom to top direction from the ground plane 80 to a highest point on the crown surface or crown apex 11. The height can be measured in a direction parallel to the y-axis 92. The height 92 can be in a range of 0.5 inch to 2.5 inches. The height 92 can be 0.5 inch, 0.6 inch, 0.7 inch, 0.8 inch, 0.9 inch, 1.0 inch, 1.1 inches, 1.2 inches, 1.3 inches, 1.4 inches, 1.5 inches, 1.6 inches, 1.7 inches, 1.8 inches, 1.9 inches, 2.0 inches, 2.1 inches, 2.2 inches, 2.3 inches, 2.4 inches, or 2.5 inches.

The mallet-style putter-type golf club head 100 can comprise a width 94. The width 94 (of a mallet-style putter type club head) as described herein can be measured in a heel-to-toe direction from the most toeward point to the most heelward point. The width 94 can be measured in a direction parallel to x-axis 82. The width 94 can be in a range of 2.0 inches to 6.0 inches. The putter width 94 can be 2.0 inches, 2.1 inches, 2.2 inches, 2.3 inches, 2.4 inches, 2.5 inches, 2.6 inches, 2.7 inches, 2.8 inches, 2.9 inches, 3.0 inches, 3.1 inches, 3.2 inches, 3.3 inches, 3.4 inches, 3.5 inches, 3.6 inches, 3.7 inches, 3.8 inches, 3.9 inches, 4.0 inches, 4.1 inches, 4.2 inches, 4.3 inches, 4.4 inches, 4.5 inches, 4.6 inches, 4.7 inches, 4.8 inches, 4.9 inches, 5.0 inches, 5.1 inches, 5.2 inches, 5.3 inches, 5.4 inches, 5.5 inches, 5.6 inches, 5.7 inches, 5.8 inches, 5.9 inches, or 6.0 inches. The aforementioned dimensions of the mallet-style putter-type golf club head can ensure a large enough crown 10 allowing for the positioning of the alignment system 50 on the crown 10.

The alignment system 50 described herein can be applied to a mallet-style and/or a mallet/blade-hybrid putter-type golf club head. The alignment system 50 comprises one or more focus elements 55. Some focus elements 55 may further comprise anomalous characteristics 57. The alignment system 50 on a putter head helps a golfer orient the putter head to the desired stroke path for the golf ball. The golfer will utilize the alignment system 50 to plan a trajectory the golfer wants the ball to roll in after struck by the putter. In one embodiment, the alignment system 50 is applied to a mallet style putter head 100 as shown in FIGS. 2-9. The incorporation of focus elements 55 into the alignment system 50 provides the means to draw the human eye into focus at a particular, desirable location. The alignment system comprises an alignment system width measured in a heel-to-toe direction in a range between 0.5 inch to 2.5 inches. The alignment system width can be 0.5 inch, 0.75 inch, 1.0 inch, 1.25 inches, 1.5 inches, 1.55 inches, 1.60 inches, 1.65 inches, 1.70 inches, 1.75 inches, 1.80 inches, 1.85 inches, 1.90 inches, 1.95 inches, 2.0 inches, 2.05 inches, 2.10 inches, 2.15 inches, 2.20 inches, 2.25 inches, 2.30 inches, 2.35 inches, 2.40 inches, 2.45 inches, or 2.5 inches. The alignment system width may be the same width as a golf ball width within the regulations of the USGA and R&A.

Further, each focus element 55 is designed to naturally draw the human eye into focus at a particular location. This attraction of the human eye focus is also known as quieting the eye—encouraging the focus of one's vision to remain on or close to a given location instead of moving away from that desired focus location. The phenomenon of vernier acuity is one form of quieting the eye. Such focus elements 55 may include straight lines, light and dark in stark juxtaposition, bright colors, color contrasts, fine detail, sharp edges, anomalies (a deviation from the common rule, type, arrangement, or form), patterns (visual indicia that repeat in a predictable way), or any arrow-like "pointers" or combinations thereof.

A. Alignment System Focus Elements

The mallet or hybrid mallet putter type golf club head can comprise an alignment system. The alignment system 50 comprises one or more focus elements 55. Each focus element 55 may comprise at least one color different from the first color of the crown 10. The crown 10 of the putter comprises a first color 64. The focus element 55 can comprise a second color 66 that is different than the first color 64, to ensure the focus element 55 can be easily seen on the crown 10. The focus element 55 can comprise one or more second colors 66. The one or more second colors 66 can be different from each other. For exemplary purposes only, the second color 66 can be a second color, a third color, a fourth color and fifth color. Wherein the second color 66, the third color, the fourth color and the fifth color are each different from each other and the first color 64. The first color 64 is a color that is different and draws out the contrast of the second color 66. The first color 64 can be a dark color such as, but not limited to, black, charcoal, or grey. The first color 64 can also be the natural color or the coated metallic material of the mallet-style putter type club head 100 metal such as aluminum, tin, titanium, steel, or a mixture thereof. Focus elements 55 may further comprise visual shapes such as a center line element, auxiliary lines, arrow-like shapes, dots, varying surface textures, varying surface height, or combinations thereof, and other features that draw the human eye into focus upon a particular location such as the crown/face junction that is aligned with a golf ball upon putting. Combinations of the above-mentioned focus elements are also included in the embodiments of this invention and some exemplary embodiments are described in the Examples below.

1. Central Line Focus Element

In some embodiments, the alignment system 50 of the mallet or hybrid mallet putter type golf club head includes at least a central line focus element 60. In other embodiments, a distinct central line element may not be present on mallet or hybrid mallet putter type golf club head. The central line focus element 60 (central line) may extend across the crown 10 in a direction from strike face 16 to rear edge 28. The central line focus element 60 may extend from the top edge 24 entirely to the rear edge 28. The central line 60 may extend rearwardly from the top edge 24. Although the crown surface may be curved, and not planar, the central line 60 is centered on the intersection of the crown surface and the yz plane 85. The central line 60 can comprise a second color 66 that preferably highly contrasts the first color 64 of the crown 10. If the crown's first color 64 is dark, the central line's second color 66 is preferably white, or some other, lighter color such as yellow. Further, it is preferable that the central line 60 has a distinct boundary or sharply demarcated edge, so that the first color is 64 in stark contrast to the second color 66. In some embodiments, the central line 60 is continuous, as shown in FIGS. 3, 4, 6, & 8. The central line 60 comprises a line width in a range between 0.05 inch to 0.25 inch. The line width may be 0.05 inch, 0.1 inch, 0.15 inch, 0.20 inch, or 0.25 inch.

Figure 2:
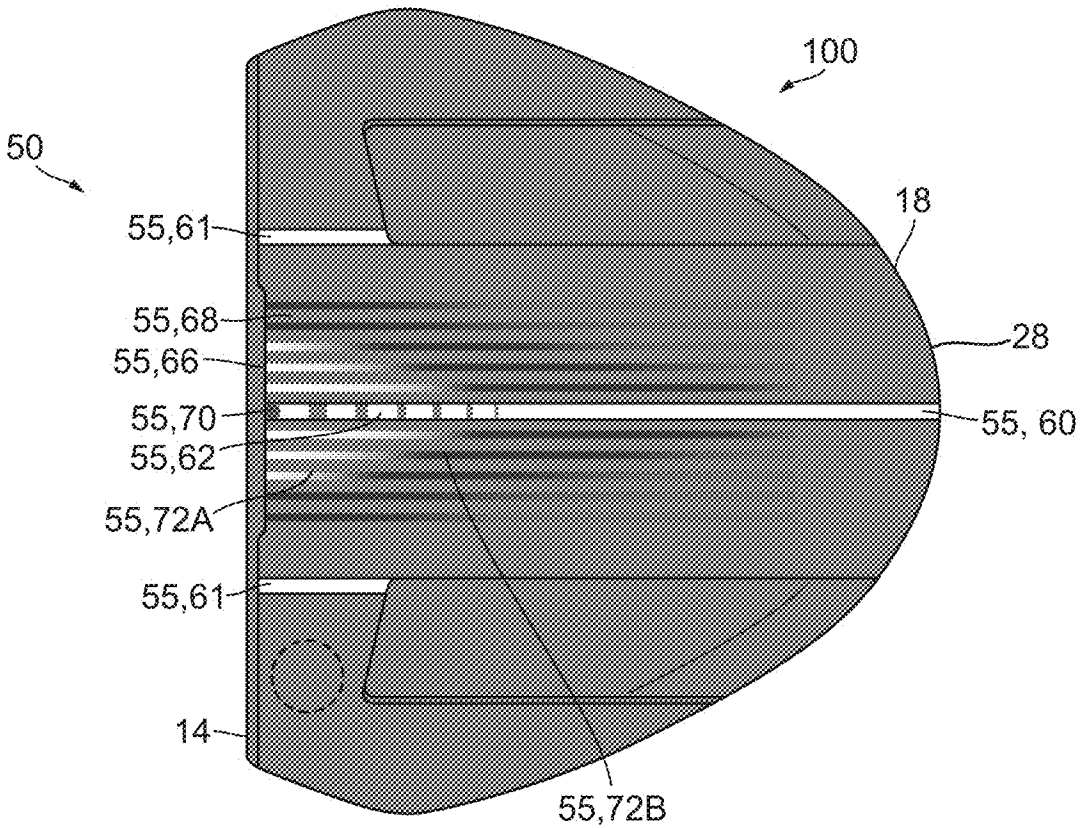
FIG. 2 illustrates a top view of the golf club head according to a first embodiment.
Figure 7:
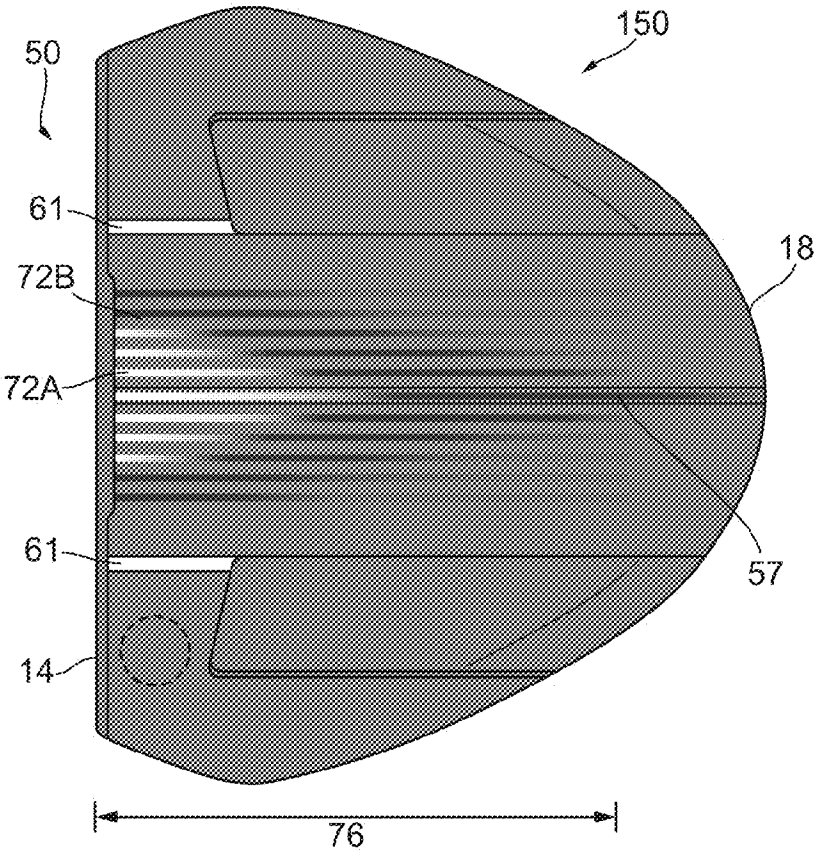
FIG. 7 illustrates a top view of the golf club according to a sixth embodiment.
Figure 11:
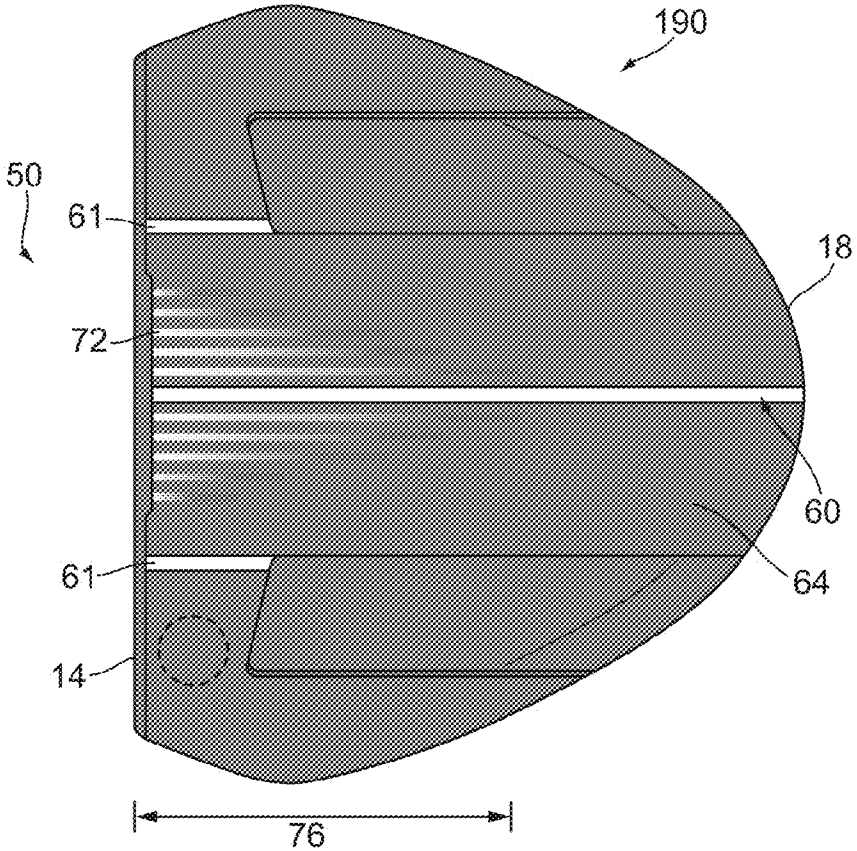
FIG. 11 illustrates a top view of the golf club according to a tenth embodiment.

The central line 60 may be paired with a pair of auxiliary lines 61. The pair of auxiliary lines 61 are configured to be parallel to the central line 60. A toeward auxiliary line is offset toeward from the central line 60. A heelward auxiliary line is offset heelward from the central line 60. The toeward auxiliary line offset distance from the central line 60 is the same as the heelward auxiliary line offset distance from the central line 60. The pair of auxiliary lines 61 can comprise the same second color 66 as the central line 60. Alternately, the pair of auxiliary lines 61 can comprise a third color 68, different from the central line color. The pair of auxiliary lines 61 can extend rearward from the top edge 24 the same distance as the central line 60. The pair of auxiliary lines 61 can extend rearward from the top edge 24 at a different distance as the central line 60. The pair of auxiliary lines 61 extend rearward the same distance as each other. The pair of auxiliary lines 61 comprise a line width that is the same as the central line 60 line width. The auxiliary lines 61 can extend partially across the length of the putter 96, as shown in FIGS. 2, 7, and 11, respectively.

In the one example of an anomalous characteristic 57, the central line 60 focus element may be changed from a solid, unbroken line to a broken line, with portions of the central line 60 having the first, crown color 64, and portions having the second color 66, creating a dashed line effect in just a front portion of the central line 60. The anomalous nature of the dashed portion of the central line 60 further contributes to the quiet eye or focusing effect of the central line 60, adding to the focusing effect of the contrasting first 64 and second colors 66, and the sharp distinct edges between the central line 60 and rest of the crown 10.

Figure 5:
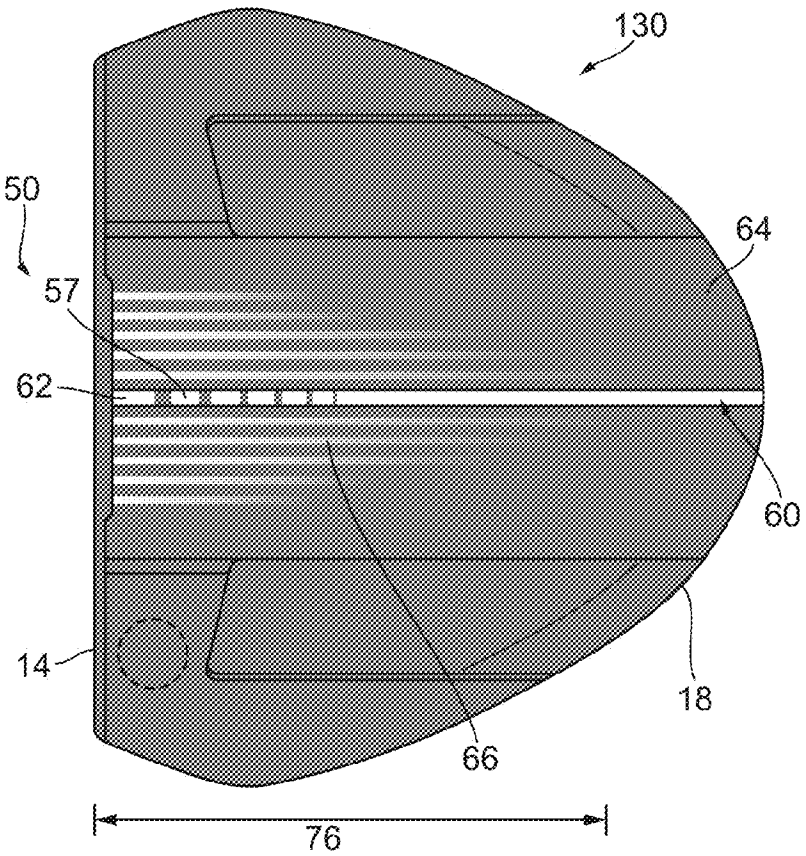
FIG. 5 illustrates a top view of the golf club head according to a fourth embodiment.
Figure 8:
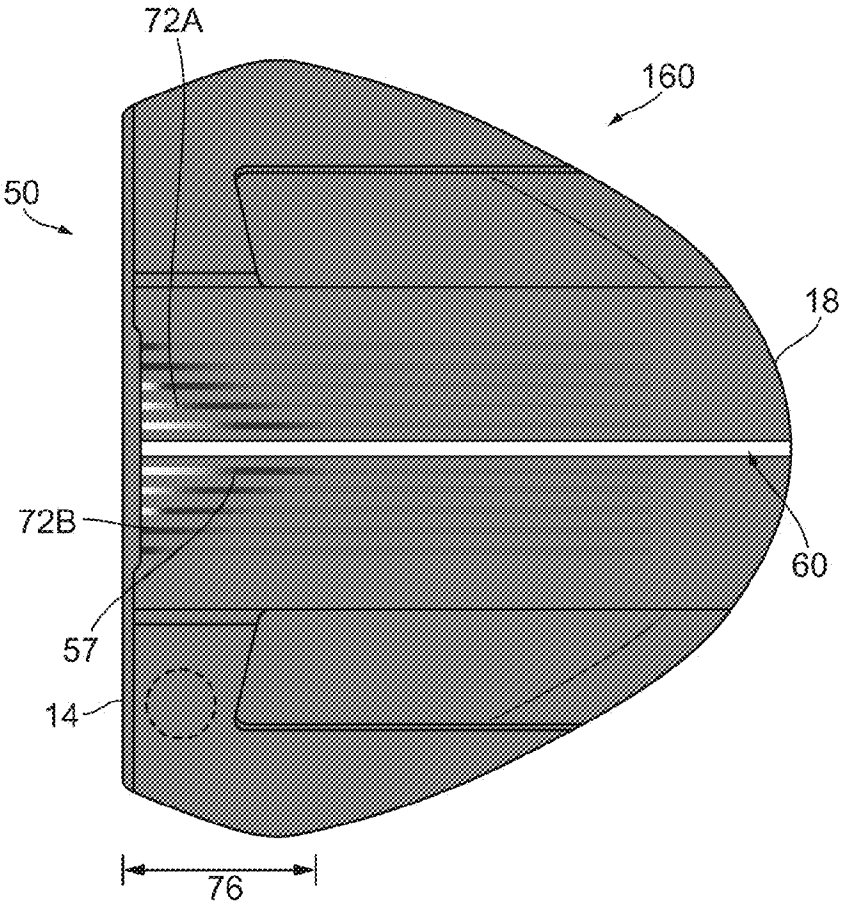
FIG. 8 illustrates a top view of the golf club according to a seventh embodiment.

For example, the central line 60 focus element can be discontinuous, as shown in FIG. 5. In these embodiments, the central line 60 may comprise a continuous portion and a discontinuous portion 62 located in the front half (closest to the strike face) of the crown 10. In some embodiments, the discontinuous portion 62 can comprise discontinuous sections. The discontinuous sections can comprise variable length sections, decreasing in length from the strike face 16 to the rear edge 28. In other embodiments, the discontinuous sections can comprise variable length sections, increasing in length from the strike face 16 to the rear edge 28. In further embodiments the discontinuous sections can comprises equal length sections, wherein the length of the section remains constant. The discontinuous sections can be separated by gaps. In some embodiments, the gaps can increase in length when moving in direction from the strike face 16 to the rear edge 28. In some embodiments, the gaps can decrease in length when moving in direction from the strike face 16 to the rear edge 28. In some embodiments, the gaps can remain constant in length. Each variation of discontinuities in the central line 60 further focuses the eye of the golfer toward the top edge 24 adjacent the golf ball.

The central line focus element 60 (central line) may extend across the crown 10 in a direction from strike face 16 to rear edge 28. The central line 60 may extend from the top edge 24 entirely to the rear edge 28. The central line 60 may extend beginning at a point displaced rearwardly from the top edge 28. Although the crown surface may be a curved surface, and not planar, the central line 60 is centered on the intersection of the crown surface and the yz plane 85. The central line 60 can comprise a second color 66 that preferably highly contrasts the first color 64 of the crown 10. If the crown's first color 64 is dark, the central line second color 66 is preferably white, or some other, lighter color such as yellow. Further, it is preferable that the central line 60 has a distinct boundary or sharply demarcated edge, so that the first color 64 is in stark contrast to the second color 66. In some embodiments, the central line 60 is continuous, as shown in FIGS. 3, 4, 6, & 8. In other embodiments, the central line 60 can be discontinuous, as shown in FIG. 5. In these embodiments, the central line 60 may comprise a discontinuous portion located in the front half (closest the strike face) of the crown 10. The discontinuous portion of the central line 60 is an example of an anomalous element.

As described above, other anomalies within focus elements 55 can be added, enhancing the focusing effect. In one embodiment, a dot 70 or small, solid circle of a contrasting color may be placed directly at the top edge centerpoint 32 where the central line 60 terminates at the top edge 24. The dot 70 may be red, magenta, green, or yellow, contrasting with and differing from both the first, crown color 64 and the second, central line color 66. The colored dot 70 is a contrast to the central line color, and is an anomaly to the golfer's eye, drawing their focus to the desired location on the putter crown 10.

In another embodiment, if the central line 60 does not terminate at the top edge 24, then the dot 70 may be the same, second color 66 as the central line 60. The space between the dot 70 and the forward termination of the central line 60 serves as another type of anomalous characteristic in the focus element.

2. Color Saturation Focus Element

A focus element 55 can comprise color saturation changes or contrasts within the individual element. The color saturation is defined above, but as described below low saturation is 1-30% on the color saturation curve and high color saturation is 70-100% on the color saturation curve defined above. One or more focus elements 55 can define a visually distinct portion of the crown. This visually distinct portion can comprise a saturation greater than that of the remainder of the crown 10, as illustrated in FIGS. 1-9. In some embodiments, the focus elements 55 can comprise one or more variants of saturation to distinguish this area from the surrounding crown, as further illustrated in FIGS. 1-9. Color saturation as described herein refers to the intensity of the color, wherein a purely saturated area would appear purely a given color and an area with low saturation would fade to the surrounding color. In color theory, saturation defines a range from pure color (100%) to gray (0%). Saturation is sometimes referred to as color intensity or chroma, a fully saturated color is one of pure color while a fully desaturated color appears as gray. Saturation makes colors more vivid (less black or white added to the pigment creating the color). Desaturation makes colors more muted (more black or white added to the pigment creating the color). A focus element 55 can comprise color saturation changes or contrasts within the individual element. For instance, a focus element 55 may have a higher color saturation near the top edge 24, and a gradually decreasing color saturation along the length of the focus element the further from the top edge 24 it extends. Further, a focus element 55 can have a beginning color with a high saturation fading to a lower saturation, with a different focus element color transitioning from the beginning color and having its own saturation progression through the focus element 55. The human eye is drawn from areas having a lower color saturation to adjacent areas having a greater color saturation. High color saturation nearest the top edge 24 will draw the golfer's eye to the desired location on the putter head. As the color fades moving front to rear of the mallet or hybrid mallet putter type golf club head the golfer's eye can use these contrast in color saturation to come to a focus point at the junction of the high color saturation design, the top edge of the crown to face junction of the putter type golf club head, and the golf ball.

3. Triangularly Dispersed Lines

Another focus element 55 may comprise a triangularly dispersed line series 72 positioned symmetrically about and parallel to the central line 60. The triangularly dispersed line series focus element 72 comprises an approximately triangular grouping of lines, wherein the apex line is co-located on the central line 60. Some embodiments can comprise a first triangularly dispersed line series 72A and a second triangularly dispersed line series 72B. Lines of progressively shorter length (measured in a front to rear direction) are symmetrically distributed on either side of the central line 60 forming a heelward portion and a toeward portion, wherein the lines are shorter as they are positioned further toeward or further heelward. This forms a generally triangular or arrow like shape that captures the attention of the user and directs the user's attention to a point adjacent the golf ball. This can intensify the users focus on the golf ball, ensuring the complete focus of the user and resulting in a more consistent and accurate putting stroke.

The triangular grouping of lines 72 comprises a focus element maximum length (measured in a front to rear direction) such that the longest line in the triangular grouping 72 of lines is 1.125 inches or less. The longest line in the triangular grouping of lines 72 can be in a range of 0.25 inch to 1.125 inches. The longest line may be 0.25 inch, 0.30 inch, 0.35 inch, 0.40 inch, 0.45 inch, 0.50 inch, 0.55 inch, 0.60 inch, 0.65 inch, 0.70 inch, 0.75 inch, 0.80 inch, 0.85 inch, 0.90 inch, 0.95 inch, 1.00 inch, 1.05 inches, 1.10 inches, 1.15 inches, 1.20 inches, or 1.25 inches.

Further the individual lines of the triangularly dispersed line series have a line width equal to or less than the central line width. The lines may preferably comprise the same line width. The lines may directly abut one another. The lines may be separated by spaces. The spaces between individual lines may be equal to or greater than the line width. The heelward portion and toeward portion may be grouped such that lines in one group are separated by one space width, and the space width between groups is larger than the space width between the lines in the same group. The spaces between lines may be the first color 64 (the main or most prevalent crown color) or the second color 66 (the central line color). Alternate lines within the triangular grouping of lines 72 may comprise the second color 66 and a third color 68. In another embodiment, the alternate lines within the triangular grouping of lines 72 may comprise the first color 64 and a third color 68 or the first color 64 and the second color 66. The triangular grouping of lines 72 comprises a focus element width, such that the focus element width from the most toeward edge of the triangular grouping of lines to the most heelward edge of the triangular grouping of lines 72 is equal to or less than the diameter of a golf ball, or 1.84 inches.

The alternate lines comprising the second and third colors may also have a varying color saturation, such that the color saturation is at a maximum proximate the top edge 24 and reduces to a minimum at a rearmost edge of the triangular grouping of lines 72. Alternately, a first, smaller triangular grouping of lines 72A may be proximate to the top edge, and a second, larger triangular grouping of lines 72B surrounds the first grouping. The visual effect is a smaller triangle having its base at the top edge 24 surrounded by a larger triangle 72B also having its base at the top edge 24, wherein the color of the smaller triangle 72A fades into the color of the larger triangle. Both the larger and smaller triangles serve as pointers to the desired aiming point on the top edge 24, the smaller triangle 72A within the larger triangle 72B is an anomaly drawing the golfer's eye, and the change of color between the smaller and larger triangles is another anomaly, which further draws the golfer's eye to the desired location. This is an example of combinations of focus elements and anomalous characteristics of those focus elements 55 working in combination.

4. Focus Element Anomalous Characteristics

Any individual focus element 55 can further comprise one or more anomalous characteristics. An anomalous characteristic may be added to focus elements 55 to further enhance the quiet eye or eye-focusing effect. An anomalous characteristic is any visible change in an established pattern, shape, or fixture. An anomalous characteristic may be a change in color, a reversal of pattern direction, a change in a pattern element such as a dotted pattern having some other shape replacing the dots in a portion of the pattern, or a combination thereof. An anomalous characteristic can be a change in the three-dimensional surface from one radius of curvature to another radius of curvature in an abrupt fashion. An anomalous characteristic can be a change of spacing between a series of parallel lines, a change of length in a series of parallel lines, or a change of color amongst a series of parallel lines. Anomalous characteristics may be applied in isolation, with only one anomalous characteristic in a single focus element within the alignment system. More than one anomalous characteristic may be applied to a single focus element 55. Anomalous characteristics may be used in combination, with a plurality of focus elements 55 each having anomalous characteristics within an alignment system 50.

B. EXAMPLES

1. Example 1

Referring to FIG. 2, a first embodiment is a mallet-style putter 100 having an alignment system 50. As discussed above, the alignment system 50 comprises a combination of any one or more of the focus elements 55 (hereafter referred to as "a plurality of focus elements"). The plurality of focus elements 55, according to the first embodiment comprises a central line 60, a dot 70, a first a triangularly dispersed line series 72A in combination with color saturation, and a second triangularly dispersed line series 72B in combination with color saturation.

The central line focus element 60 discontinuously extends across the crown 10 in a direction from a point near the strike face 16 to the rear edge 28. The central line 60 is centered on the intersection of the crown surface and the yz plane 85. The central line 60 comprises a second color 66 while the crown 10 comprises a first color 64. The first color 64 is black and the second color 66 is white to highly contrast with the first color 64. The central line 60 comprises a continuous portion and a discontinuous portion located in the front half (closest to the strike face) of the crown 10. The discontinuous sections comprise variable length sections, decreasing in length from the strike face 16 to the rear edge 28. The discontinuous sections are separated by gaps, wherein the gaps increase in length when moving in a direction from the strike face to the rear. The discontinuous sections add an anomalous characteristic to the plurality of focus elements 55. The discontinuous sections disrupt the pattern of central line 60. This disruption draws the user's eye away from the continuous portion of the central line positioned towards the rear portion 18 of the head and towards the discontinuous portion of the central line 60 positioned adjacent the golf ball. This anomalous characteristic enhances the quiet eye by focusing the user's eye on a position directly adjacent the golf ball.

The dot 70 is positioned on the crown 10 directly adjacent the top edge 24 and adjacent to where the central line 60 terminates. The dot 70 comprises a third color 68 wherein the third color 68 is different from the first color 64 and the second color 66 to draw the focus of the user's eye to a point adjacent to the golf ball. The third color 68 is red. The dot 70 itself as well as the color of the dot add anomalous characteristics to the plurality of focus elements 55. The dot 70 acts as a change in pattern as it is positioned in line with the central line 60, while the color makes it easily visible. These anomalous characteristics enhance the quiet eye by focusing the user's eye on a position directly adjacent to the golf ball.

The first triangularly dispersed line series 72A is positioned symmetrically about and parallel to the central line 60. The first triangularly dispersed line series 72A comprises an approximately triangular grouping of lines, wherein the apex line is co-located on the central line 60.

The lines each have a line width less than the central line width. The lines are separated by spaces. The spaces between individual lines are greater than the line width. The spaces comprise a color wherein the color is the same as the first color. Lines of progressively shorter length (measured in a front to rear direction) are symmetrically distributed on either side of the central line forming a heelward portion and a toeward portion, wherein the lines are shorter as they are positioned further toeward or further heelward. The lines comprise a third color, wherein the third color is blue. The lines have a varying color saturation, such that the color saturation is at a maximum proximate the top edge 24 and reduces to a minimum at a rearmost edge of the first triangular grouping of lines 72A.

The second triangularly dispersed line series 72B overlays the first triangular dispersed line series 72A. The second triangularly dispersed line series 72B comprises an approximately triangular grouping of lines, wherein the apex line is co-located on the central line. The lines each have a line width less than the central line width. The lines are separated by spaces. The spaces between individual lines are greater than the line width. The spaces comprise a color wherein the color is the same as the first color 64. Lines of progressively shorter length (measured in a front to rear direction) are symmetrically distributed on either side of the central line forming a heelward portion and a toeward portion, wherein the lines are shorter as they are positioned further toeward or further heelward. The lines comprise a color, wherein the color is the second color 66. The lines have a varying color saturation, such that the color saturation is at a maximum proximate the top edge 24 and reduces to a minimum at a rearmost edge of the triangular grouping of lines 72B, such that the first triangularly dispersed line series 72A can be seen. The visual effect is the smaller triangle (the second triangularly dispersed line series 72B) having its base at the top edge 24 surrounded by a larger triangle (the first triangularly dispersed line series 72A) also having its base at the top edge 24, wherein the color of the smaller triangle fades into the color the larger triangle. Drawing the focus of the user's eyes to a point directly adjacent the golf ball for the duration of the putting stroke. Ensuring the complete focus of the user and resulting in a more consistent and accurate putting stroke.

2. Example 2

Figure 3:
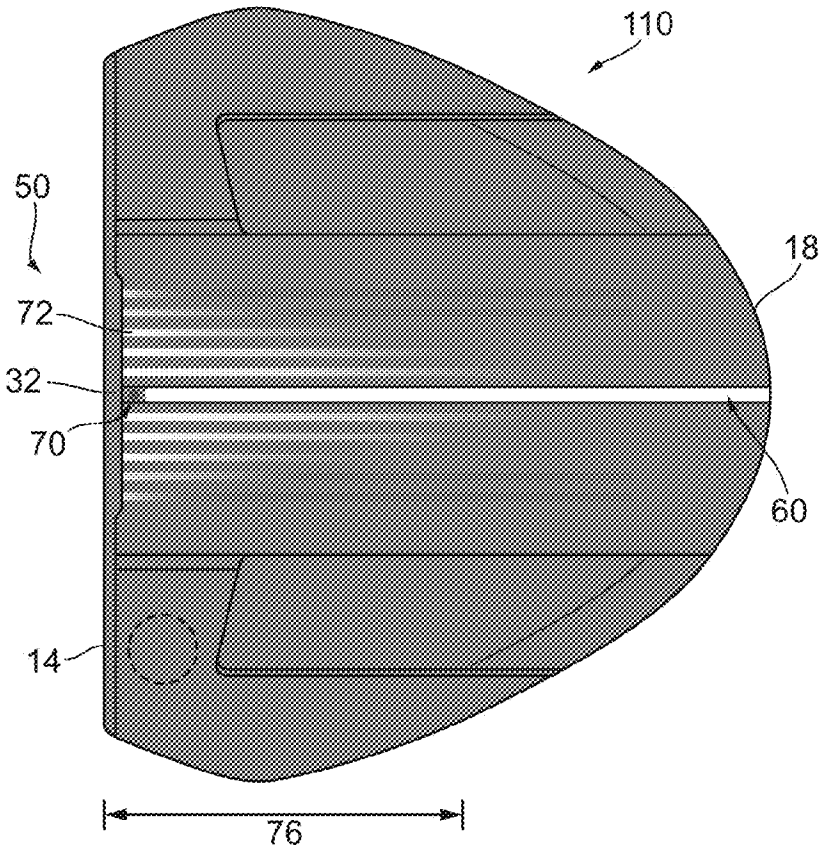
FIG. 3 illustrates a top view of the golf club head according to a second embodiment.

Referring to FIG. 3, a second embodiment of a mallet-style putter 110 having an alignment system 50. As discussed above, the alignment system 50 comprises a combination of any one or more of the focus elements 55 (hereafter referred to as "a plurality of focus elements"). The plurality of focus elements 55, according to the second embodiment comprises a central line 60, a dot 70, and a triangularly dispersed line series 72.

The central line focus element 60 continuously extends across the crown 10 in a direction from a point near the strike face 16 to the rear edge 28. The central line 60 is centered on the intersection of the crown surface and the yz plane 85. The central line 60 comprises a second color 66 while the crown 10 comprises a first color 64. The first color 64 is black and the second color 66 is white as to highly contrast with the first color 64.

The dot 70 is positioned on the crown 10 directly adjacent the top edge 24 and adjacent to where the central line 60 terminates. The dot 70 comprises a third color 68 wherein the third color 68 is different from the first color 64 and the second color 66 to draw the focus of the user's eye to a point adjacent the golf ball. The third color 68 is red. The dot 70 itself as well as the color of the dot add anomalous characteristics to the plurality of focus elements 55. The dot 70 acts as a change in pattern as it is positioned in line with the central line 60, while the color makes it easily visible. These anomalous characteristics enhance the quiet eye by focusing the user's eye on a position directly adjacent to the golf ball.

The triangularly dispersed line series 72 are positioned symmetrically about and parallel to the central line 60. The triangularly dispersed line series 72 comprises an approximately triangular grouping of lines 72, wherein the apex line is co-located on the central line 60. The triangularly dispersed line series 72 is positioned withing the first half of the club head. Lines of progressively shorter length (measured in a front to rear direction) are symmetrically distributed on either side of the central line 60 forming a heelward portion and a toeward portion, wherein the lines are shorter as they are positioned further toeward or further heelward. The lines have a varying color saturation, such that the color saturation is at a maximum proximate the top edge 24 and reduces to a minimum at a rearmost edge of the triangular grouping of lines. The lines each have a line width less than the central line width. The lines are separated by spaces. The spaces between individual lines are equal the line width. The spaces comprise a color wherein the color is the same as the first color 64. The combination of the central line 60, the dot 70, and the triangularly dispersed line series 72 draws the focus of the users eyes to a point directly adjacent the golf ball for the duration of the putting stroke. Such focus helps ensure the complete focus of the user and resulting in a more consistent and accurate putting stroke.

3. Example 3

Figure 4:
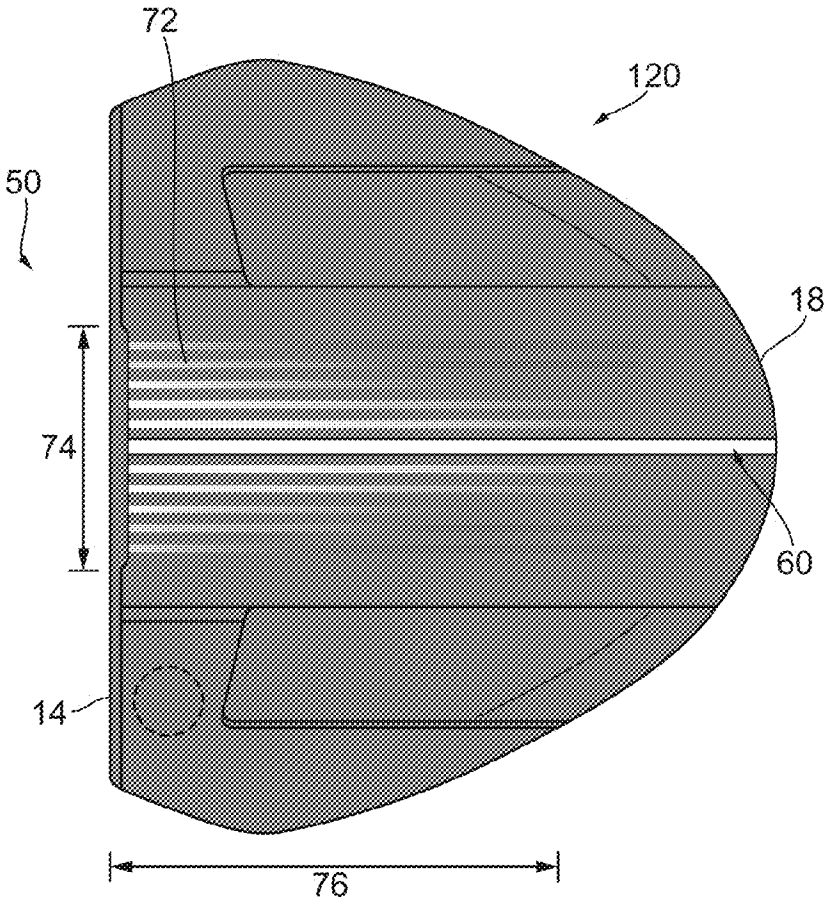
FIG. 4 illustrates a top view of the golf club head according to a third embodiment.

Referring to FIG. 4, a third embodiment is a mallet-style putter 120 having an alignment system 50. As discussed above, the alignment system comprises a combination of any one or more of the focus elements 55 (hereafter referred to as "a plurality of focus elements"). The plurality of focus elements 55, according to the third embodiment comprises a central line 60 and a triangularly dispersed line series 72. The alignment system 50 has an alignment system width 74 and an alignment system length 76.

The central line 60 continuously extends across the crown 10 in a direction from the strike face 16 to the rear edge 28. The central line 60 is centered on the intersection of the crown surface and the yz plane 85. The central line 60 comprises a second color 66 while the crown comprises a first color 64. The first color 64 is black and the second color 66 is white as to highly contrast with the first color 64.

The plurality of focus elements 55 further comprises of a triangularly dispersed line series 72. The triangularly dispersed line series are positioned symmetrically about and parallel to the central line. The triangularly dispersed line series 72 comprises an approximately triangular grouping of lines, wherein the apex line is co-located on the central line. Lines of progressively shorter length (measured in a front to rear direction) are symmetrically distributed on either side of the central line 60 forming a heelward portion and a toeward portion, wherein the lines are shorter as they are positioned further toeward or further heelward. The lines have a varying color saturation, such that the color saturation is at a maximum proximate the top edge 24 and reduces to a minimum at a rearmost edge of the triangular grouping of lines 72. The lines each have a line width less than the central line width. The lines are separated by spaces. The spaces between individual lines are greater than the line width. The spaces comprise a color wherein the color is the same as the first color. The combination of the central line 60, the dot 70, and the triangularly dispersed line series 72 draws the focus of the user's eyes to a point directly adjacent the golf ball for the duration of the putting stroke. Ensuring the complete focus of the user and resulting in a more consistent and accurate putting stroke.

4. Example 4

Referring to FIG. 5, a fourth embodiment is a mallet-style putter 130 having an alignment system 50. As discussed above, the alignment system 50 comprises a combination of any one or more of the focus elements 55 (hereafter referred to as "a plurality of focus elements"). The plurality of focus elements 55, according to the fourth embodiment comprises a discontinuous central line 60 and a triangularly dispersed line series 72.

The central line 60 discontinuously extends across the crown 10 in a direction from a the strike face 16 to the rear edge 28. The central line 60 is centered on the intersection of the crown surface and the yz plane 85. The central line 60 comprises a second color 66 while the crown comprises a first color 64. The first color 64 is black, and the second color 66 is white to highly contrast with the first color 64. The central line 60 comprises a continuous portion and a discontinuous portion located in the front half (closest to the strike face) of the crown 10. The discontinuous sections comprise variable length sections, decreasing in length from the strike face 16 to the rear edge 28. The discontinuous sections are separated by gaps, wherein the gaps increase in length when moving in a direction from the strike face to the rear. The discontinuous sections add an anomalous characteristic to the plurality of focus elements 55. The discontinuous sections disrupt the pattern of central line 60. This disruption draws the user's eye away from the continuous portion of the central line positioned towards the rear portion 18 of the head and towards the discontinuous portion of the central line 60 positioned adjacent the golf ball. This anomalous characteristic enhances the quiet eye by focusing the user's eye on a position directly adjacent the golf ball.

The plurality of focus elements 55 further comprises of a triangularly dispersed line series 72. The triangularly dispersed line series 72 are positioned symmetrically about and parallel to the central line 60. The triangularly dispersed line series 72 comprises an approximately triangular grouping of lines, wherein the apex line is co-located on the central line 60. Lines of progressively shorter length (measured in a front to rear direction) are symmetrically distributed on either side of the central line forming a heelward portion and a toeward portion, wherein the lines are shorter as they are positioned further toeward or further heelward. The lines have a varying color saturation, such that the color saturation is at a maximum proximate the top edge and reduces to a minimum at a rearmost edge of the triangular grouping of lines. The lines each have a line width less than the central line width. The lines are separated by spaces. The spaces between individual lines are greater than the line width. The spaces comprise a color wherein the color is the same as the first color. The combination of the central line 60, the dot 70, and the triangularly dispersed line series 72 draws the focus of the users eyes to a point directly adjacent the golf ball for the duration of the putting stroke. Ensuring the complete focus of the user and resulting in a more consistent and accurate putting stroke.

5. Example 5

Figure 6:
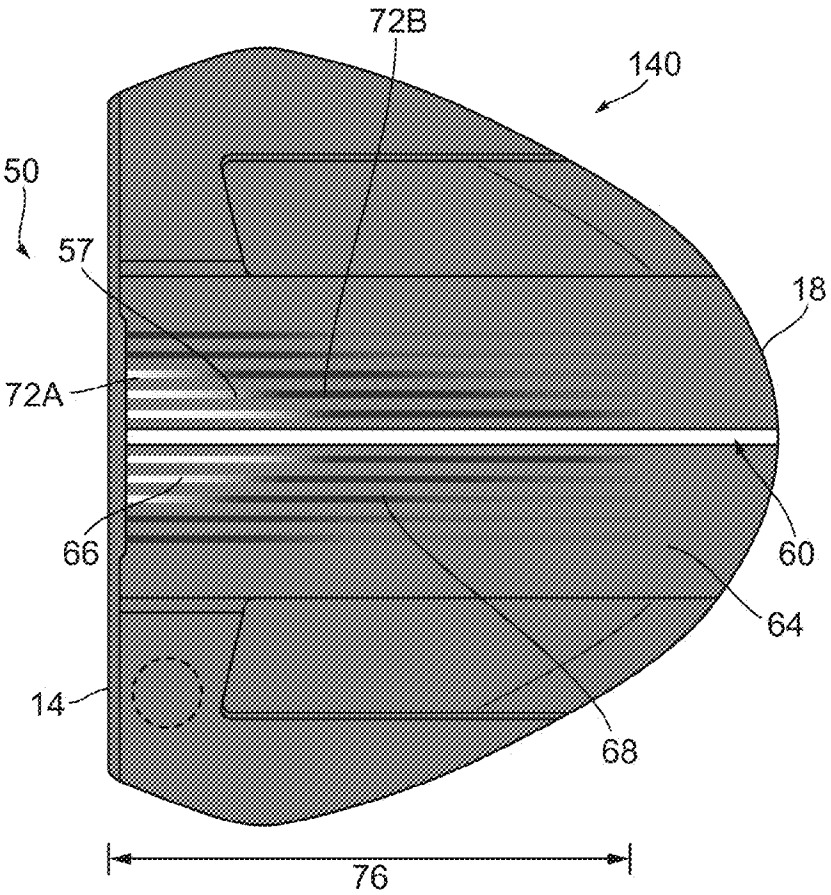
FIG. 6 illustrates a top view of the golf club head according to a fifth embodiment.

Referring to FIG. 6, a fifth embodiment is a mallet-style putter 140 having an alignment system 50. As discussed above, the alignment system 50 comprises a combination of any one or more of the focus elements 55 (hereafter referred to as "a plurality of focus elements"). The plurality of focus elements 55, according to the fifth embodiment comprises a first triangularly dispersed line series 72A, a second triangularly dispersed line series 72B, color saturation, and a central line 60.

The central line 60 continuously extends across the crown 10 in a direction from a the strike face 16 to the rear edge 28. The central line 60 is centered on the intersection of the crown surface and the yz plane 85. The central line 60 comprises a second color 66 while the crown comprises a first color 64. The first color 64 is black and the second color 66 is white as to highly contrast with the first color 64.

The first triangularly dispersed line series 72A are positioned symmetrically about and parallel to the central line 60. The first triangularly dispersed line series 72A comprises an approximately triangular grouping of lines, wherein the apex line is co-located on the central line 60. The lines each have a line width less than the central line width. The lines are separated by spaces. The spaces between individual lines are greater than the line width. The spaces comprise a color wherein the color is the same as the first color. Lines of progressively shorter length (measured in a front to rear direction) are symmetrically distributed on either side of the central line forming a heelward portion and a toeward portion, wherein the lines are shorter as they are positioned further toeward or further heelward. The lines comprise a third color, wherein the third color is blue. The lines have a varying color saturation, such that the color saturation is at a maximum proximate the top edge 24 and reduces to a minimum at a rearmost edge of the first triangular grouping of lines 72A.

The second triangularly dispersed line series 72B overlays the first triangular dispersed line series 72A. The second triangularly dispersed line series 72B is positioned withing the first half of the club head. The second triangularly dispersed line series 72B comprises an approximately triangular grouping of lines, wherein the apex line is co-located on the central line. The lines each have a line width less than the central line width. The lines are separated by spaces. The spaces between individual lines are greater than the line width. The spaces comprise a color wherein the color is the same as the first color 64. Lines of progressively shorter length (measured in a front to rear direction) are symmetrically distributed on either side of the central line forming a heelward portion and a toeward portion, wherein the lines are shorter as they are positioned further toeward or further heelward. The lines comprise a color, wherein the color is the second color 66. The lines have a varying color saturation, such that the color saturation is at a maximum proximate the top edge 24 and reduces to a minimum at a rearmost edge of the second triangular grouping of lines 72B, such that the first triangularly dispersed line series 72A can be seen. The visual effect is the smaller triangle (the second triangularly dispersed line series 72B) having its base at the top edge 24 surrounded by a larger triangle (the first triangularly dispersed line series 72A) also having its base at the top edge 24, wherein the color of the smaller triangle fades into the color the larger triangle. Drawing the focus of the user's eyes to a point directly adjacent the golf ball for the duration of the putting stroke. Ensuring the complete focus of the user and resulting in a more consistent and accurate putting stroke.

6. Example 6

Referring to FIG. 7, a sixth embodiment is a mallet-style putter 150 having an alignment system 50. As discussed above, the alignment system 50 comprises a combination of any one or more of the focus elements 55 (hereafter referred to as "a plurality of focus elements"). The plurality of focus elements 55, according to the sixth embodiment comprises two auxiliary lines 61, a first triangularly dispersed line series 72A, a second triangularly dispersed line series 72B, and color saturation.

The two auxiliary lines 61 comprised a toe-side auxiliary line and a heel-side auxiliary line are spaced apart from the central line 60 towards the toe portion 20 and heel portion 22 respectively. The two auxiliary lines 61 were spaced symmetrically about the z-axis 86 in that they were each the same absolute distance from the z-axis 86. The two auxiliary lines 61 further comprised a second color 66 wherein each of the three lines comprised the same color. The second color 66 was white. The two auxiliary lines act a means for lining up the desired trajectory of the putt in the absence of the more traditional central line as discussed elsewhere.

The first triangularly dispersed line series 72A are positioned symmetrically about and parallel to the central line 60. The first triangularly dispersed line series 72A comprises an approximately triangular grouping of lines, wherein the apex line is co-located on the central line 60. The lines each have a line width less than the central line width. The lines are separated by spaces. The spaces between individual lines are greater than the line width. The spaces comprise a color wherein the color is the same as the first color. Lines of progressively shorter length (measured in a front to rear direction) are symmetrically distributed on either side of the central line forming a heelward portion and a toeward portion, wherein the lines are shorter as they are positioned further toeward or further heelward. The lines comprise a third color, wherein the third color is blue. The lines have a varying color saturation, such that the color saturation is at a maximum proximate the top edge 24 and reduces to a minimum at a rearmost edge of the first triangular grouping of lines 72A.

The second triangularly dispersed line series 72B overlays the first triangular dispersed line series 72A. The second triangularly dispersed line series 72B is positioned withing the first half of the club head. The second triangularly dispersed line series 72B comprises an approximately triangular grouping of lines, wherein the apex line is co-located on the central line. The lines each have a line width less than the central line width. The lines are separated by spaces. The spaces between individual lines are greater than the line width. The spaces comprise a color wherein the color is the same as the first color 64. Lines of progressively shorter length (measured in a front to rear direction) are symmetrically distributed on either side of the central line forming a heelward portion and a toeward portion, wherein the lines are shorter as they are positioned further toeward or further heelward. The lines comprise a second color 66. The lines have a varying color saturation, such that the color saturation is at a maximum proximate the top edge 24 and reduces to a minimum at a rearmost edge of the second triangular grouping of lines 72B, such that the first triangularly dispersed line series 72A can be seen. The visual effect is the smaller triangle (the second triangularly dispersed line series 72B) having its base at the top edge 24 surrounded by a larger triangle (the first triangularly dispersed line series 72A) also having its base at the top edge 24, wherein the color of the smaller triangle fades into the color the larger triangle. Drawing the focus of the user's eyes to a point directly adjacent the golf ball for the duration of the putting stroke. Ensuring the complete focus of the user and resulting in a more consistent and accurate putting stroke.

7. Example 7

Figure 9:
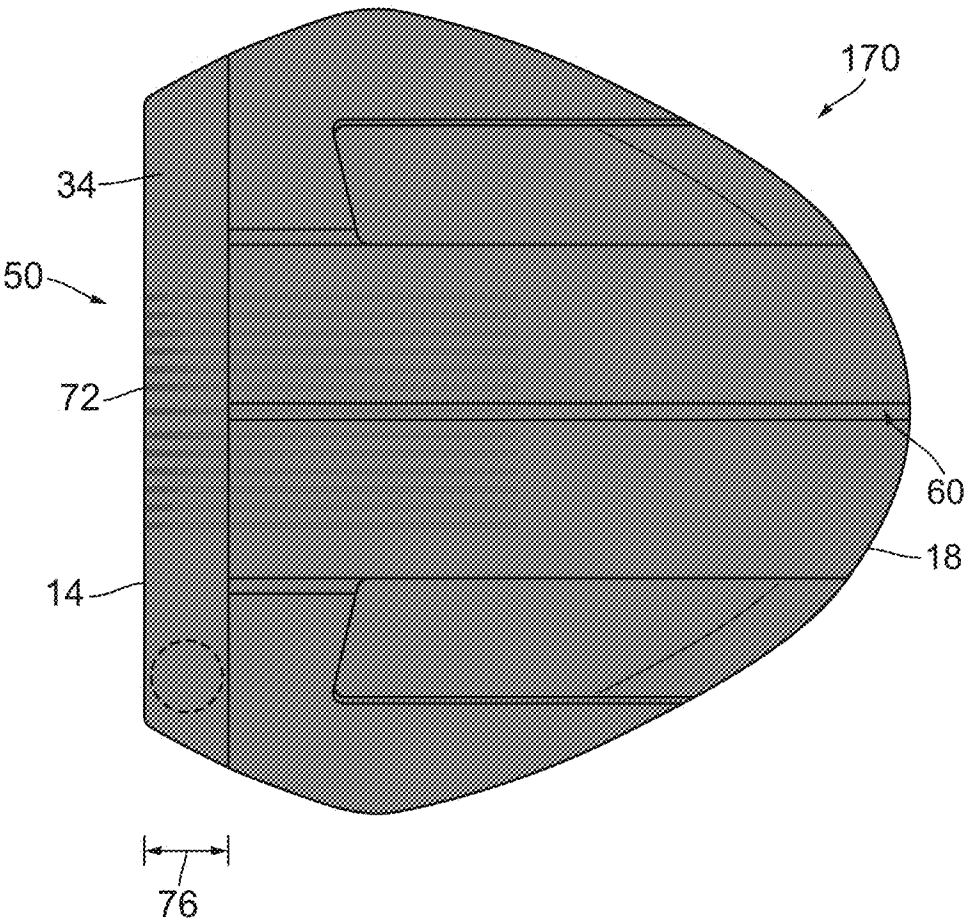
FIG. 9 illustrates a top view of the golf club according to an eighth embodiment.

Referring to FIG. 9, an eighth embodiment is a hybrid mallet-style putter 170 having an alignment system 50. The hybrid mallet-style putter comprises a top rail in addition to a crown. The alignment system is positioned on the top rail and the crown. The alignment system 50 comprises a combination of any one or more of the focus elements 55 (hereafter referred to as "a plurality of focus elements"). The plurality of focus elements 55, according to the seventh embodiment comprises a central line 60 and a triangularly dispersed line series.

The central line 60 continuously extends from the rear edge 28 to the top rail 34. The central line 60 is centered on the intersection of the crown surface and the yz plane 85. The central line 60 comprises a second color 66 while the crown comprises a first color 64. The first color 64 is black and the second color 66 is white as to highly contrast with the first color 64.

The plurality of focus elements 55 further comprises of a triangularly dispersed line series 72. The triangularly dispersed line series 72 is positioned solely on the top rail and within half a golf ball of the strikeface. The triangularly dispersed line series 72 is positioned symmetrically about and parallel to the central line. The triangularly dispersed line series 72 comprises an approximately triangular grouping of lines, wherein the apex line is co-located on the central line. Lines of progressively shorter length (measured in a front to rear direction) are symmetrically distributed on either side of the central line 60 forming a heelward portion and a toeward portion, wherein the lines are shorter as they are positioned further toeward or further heelward.

The triangularly dispersed line series 72 comprise a third color, wherein the third color is different than the first and second color. The lines have a varying color saturation, such that the color saturation is at a maximum proximate the top edge 24 and reduces to a minimum at a rearmost edge of the triangular grouping of lines 72. The lines each have a line width less than the central line width. The lines are separated by spaces. The spaces between individual lines are greater than the line width. The spaces comprise a color wherein the color is the same as the first color. The combination of the central line 60 and the triangularly dispersed line series 72 draws the focus of the user's eyes to a point directly adjacent the golf ball for the duration of the putting stroke. Ensuring the complete focus of the user and resulting in a more consistent and accurate putting stroke.

8. Example 8

Figure 10:
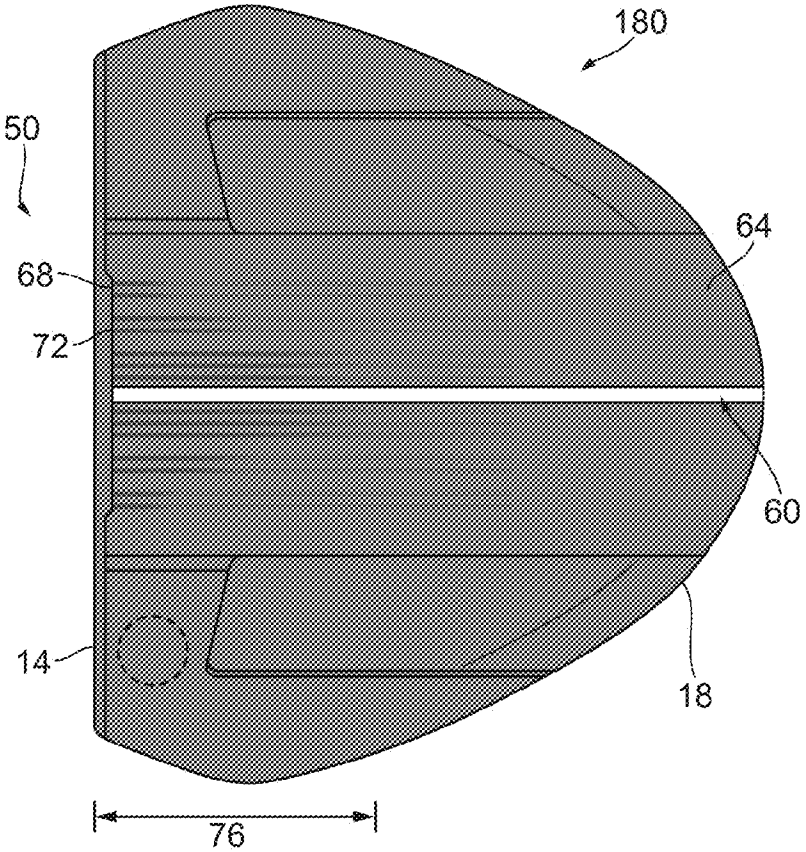
FIG. 10 illustrates a top view of the golf club according to a ninth embodiment.
Figure 12:
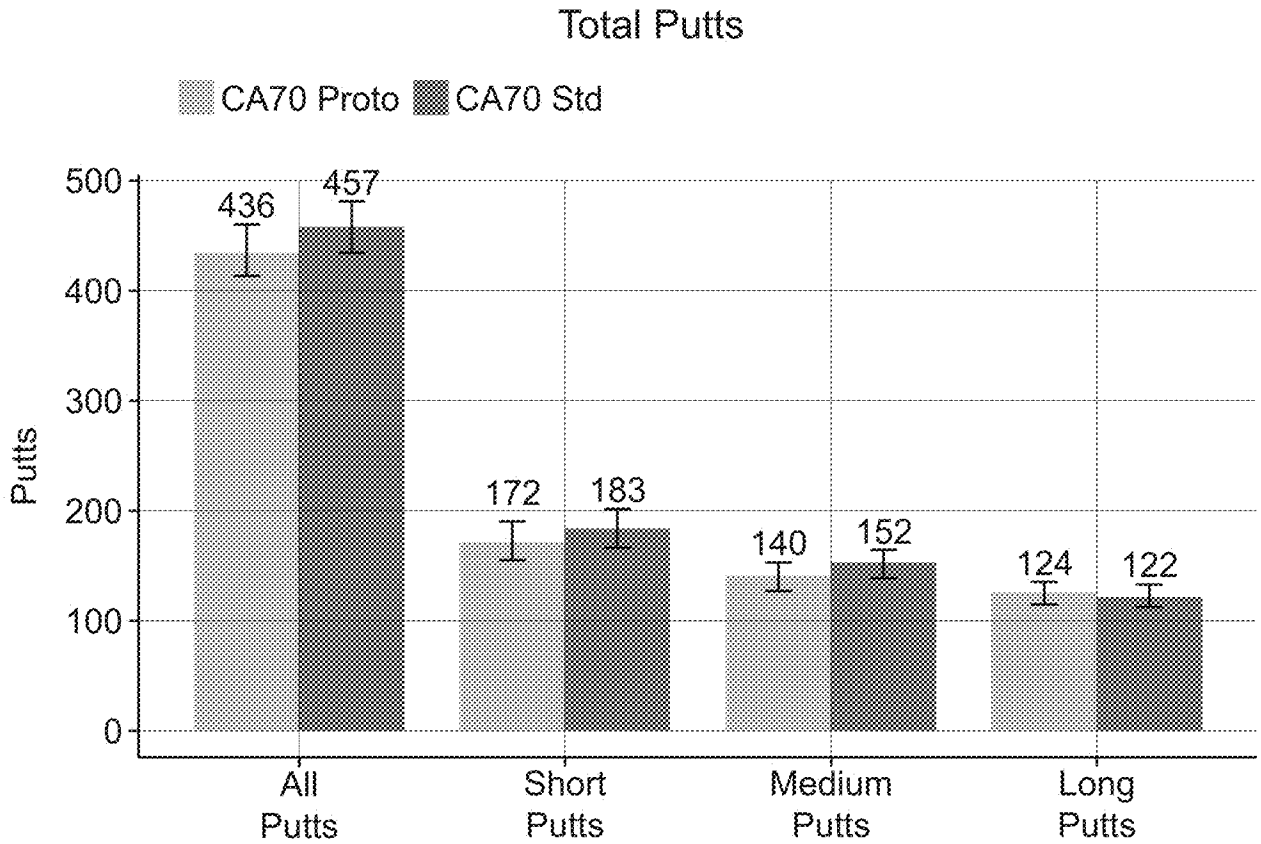
FIG. 12 illustrates a bar graph with comparable putting data between a first exemplary example of a golf club head and a standard golf club head.
Figure 13:
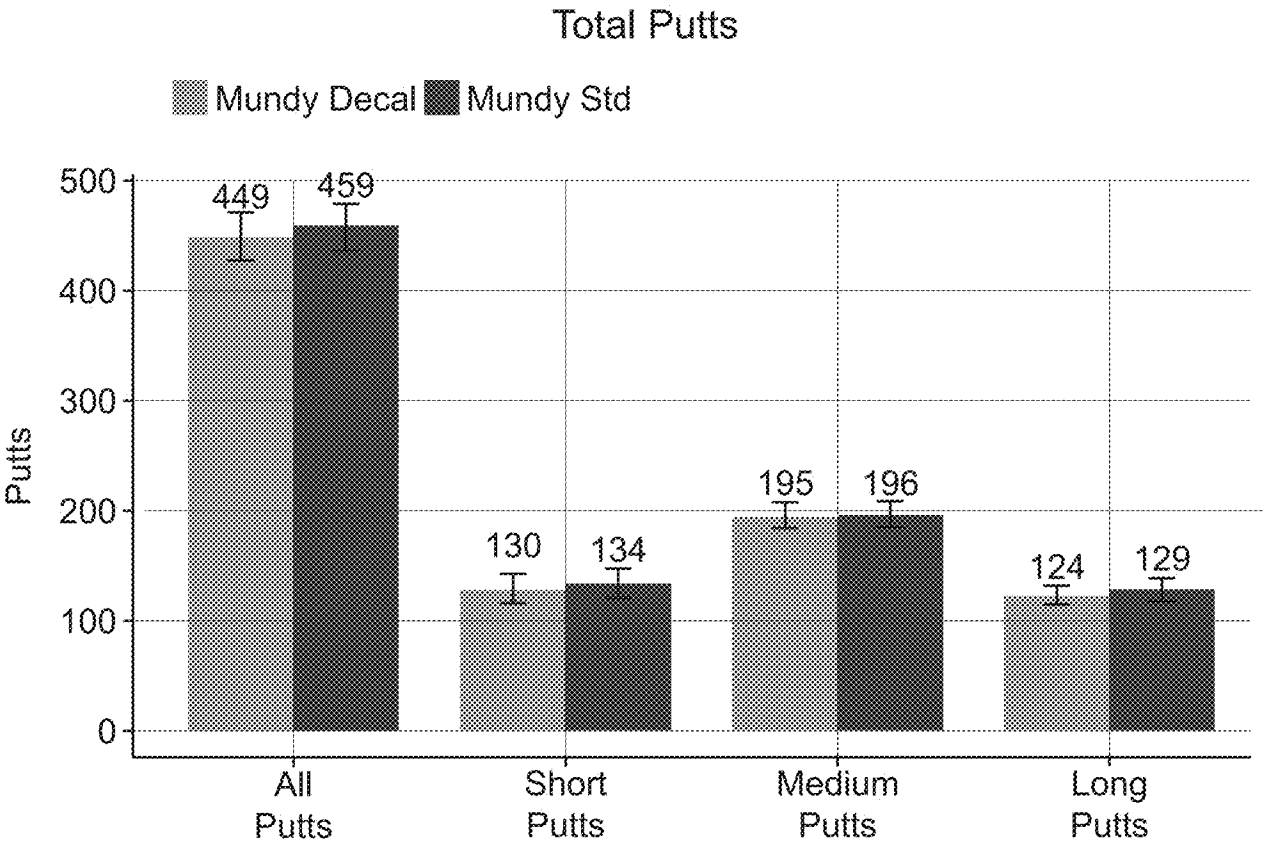
FIG. 13 illustrates a bar graph with comparable putting data between a second exemplary example of a golf club head and a standard golf club head.

The time in which a golfer spends looking at a club was tracked and recorded for an exemplary example putter and a standard putter. The exemplary example club comprised a mallet-style head 180 and an alignment system 50 similar to the alignment system 50 of FIG. 10. The standard putter comprised a mallet-style putter-type head of similar weight and dimensions but lacked any such alignment system focus element. The remaining focus elements were the same throughout the two putters.

The eye movement of multiple players was tracked throughout a swing with both the exemplary example putter and the standard putter using Tobii Pro Glasses 2™ technology. The sites at which the user's gaze traveled were marked with pixels. These pixels formed a "gaze plot" to illustrate where the user was focused and for how long, otherwise known as their attention time. The area of the "gaze plot" was divided by the attention time in order to normalize the swing focus between each user. This way, a player who takes longer on average to swing would not skew the results for overall focus. The value of the results, in pixels/second, shows how much the user's eyes roamed throughout the swing. A lower value, for example, means the area of the gaze plot was lower, and as such, that person's eyes remained more in one place throughout their swing. Conversely, a higher value would mean the person's eyes roamed about, increasing the area of their gaze plot over time.

TABLE I

Area/Attention Time for Exemplary Example Putter vs. Standard Putter

| | Area/Attention Time (pixels/second) | | |
|---|---|---|---|
| Player No. | Exemplary Example Putter | Standard Putter | Percent Difference (%) |
| 1 | 57.33 | 59.31 | −3.39 |
| 2 | 59.50 | 78.32 | −27.31 |
| 3 | 131.24 | 81.91 | 46.29 |
| 4 | 115.81 | 111.72 | 3.59 |
| 5 | 75.60 | 68.13 | 10.39 |
| 6 | 116.17 | 182.06 | −44.20 |
| 7 | 66.35 | 49.86 | 28.38 |
| 8 | 21.17 | 52.25 | −84.66 |
| 9 | 74.28 | 101.16 | −30.64 |
| Average | 79.72 | 87.19 | −8.95 |

As Table I shows, the ratio of the average player's gaze area over their attention time decreased by 8.95% between the standard putter and the exemplary example putter comprising an alignment system 50. These results show that players' eyes travelled less with the exemplary example putter, meaning that they were able to better focus throughout their swings. The exemplary example putter and the standard putter were similar in dimension and elements, however, the exemplary example putter further comprised an alignment system. Therefore, likely the alignment system 50 helped to decrease eye movement when compared to a putter without an alignment system 50. Due to the linked relationship between the quiet eye phenomenon and improved performance, less eye movement would lead to improved focus and a better swing. In conclusion, the exemplary example putter comprising an alignment system 50 decreased user eye movement versus the standard putter lacking any alignment system, suggesting better player performance for the exemplary example putter.

9. Example 9

The total number of putts taken throughout a first round of golf (eighteen holes) was recorded for twenty players using a standard mallet-style putter head with only a central line focus element on the crown. The total number of putts taken throughout a second round was then recorded for the same twenty players using a mallet-style putter head with an exemplary example of the alignment system 50 described herein. The standard putter head and the exemplary example putter head otherwise comprised similar weight, dimension, and mass properties. The first and second round of golf were played on the same course with similar conditions.

The exemplary example mallet-style putter-type golf club head alignment system 50 comprised a central line 60, two auxiliary lines 61 spaced apart from and parallel to the central line, and triangularly dispersed lines 72 arranged symmetrically about and parallel to the central line 60. The crown comprised a first color 64. The first color was black or dark gray. The central line 60 extended from the top edge centerpoint 32 to the rear edge 28 across the entire length of the crown 10. The two auxiliary lines 61 comprised a toe-side auxiliary line and a heel-side auxiliary line are spaced apart from the central line 60 towards the toe portion 20 and heel portion 22 respectively. The two auxiliary lines 61 were spaced symmetrically about the central line in that they were each the same absolute distance from the central line. The central line 60 and the two auxiliary lines 61 comprised a line width, and the line width of each of the central line 60 and the two auxiliary lines was the same. A distance between the toe-side auxiliary line and a heel-side auxiliary line was 1.84 inches, or the same as the diameter of a golf ball. The central line 60 and the two auxiliary lines 61 further comprised a second color 66 wherein each of the three lines comprised the same color. The second color 66 was white.

The triangularly dispersed lines focus element 72 comprised an approximately triangular grouping of parallel lines, wherein the apex line was co-located on the central line 60. Lines of progressively shorter length (measured in a front to rear direction) were symmetrically distributed on either side of the central line 60 forming a heelward portion and a toeward portion, wherein the lines were shorter as they are positioned further toeward or further heelward. The lines each comprised a line width equal to or less than the central line width. The triangularly dispersed lines 72 further comprised spaces between the lines having a spacing width equal to the triangular element line width. The triangular element lines comprised the same second color 66 as the central line 60. The spaces comprised the same first, crown color 64. The triangular element lines further comprised a varying color saturation. The color saturation of the lines was highest proximate to the top edge 24, and the color saturation gradually decreased as the lines extend rearward. At the most rearward edge of each of the triangular element lines, the color saturation of the second color faded to zero value, thereby blending into the first crown color 64.

The starting position of the ball before putting was measured and sorted into three categories of distance—"short," "medium," and "long," putts. "Short" putts as used in the table below are defined as strokes taken where the position of the ball was less than ten feet from the hole. "Medium" putts are defined as strokes taken where the position of the ball was 10-20 feet from the hole. "Long" putts are defined as strokes taken where the position of the ball was greater than 20 feet from the hole.

Someone who plays consistently with their other clubs and improves their putting would lower their overall score. The lower the number of putts made, the lower the overall number of shots throughout the game, thereby achieving a better score. As such, counting the number of putts made throughout the game with a standard club vs. the exemplary example club as detailed herein is reflective of player performance. Table 2 below presents the recorded number of putts taken by the twenty players in both the first round of golf with the standard putter and the second round of golf with the exemplary example putter comprising an alignment system.

TABLE 2

| Total Putts Required per Round of Golf with Standard Putter vs. Exemplary Example Putter | | | | | |
|---|---|---|---|---|---|
| | Short putts (<10 ft) | Medium putts (10-20 ft) | Long putts (>20 ft) | Total | Putts/ Round/Person |
| Standard | 134 | 196 | 129 | 459 | 22.95 |
| Exemplary Example | 130 | 195 | 124 | 449 | 22.45 |

As Table 2 above shows, the players overall used ten fewer putts when using the exemplary example putter comprising an alignment system 50 with a combination of focus elements 55 versus the standard putter lacking an alignment system. The total number of putts counted is reflective of various putting distances to display an improved performance regardless of distance from the hole. The overall number of short putts made throughout the game was less for the exemplary example putter than the standard putter. The overall number of medium putts as well as long putts made throughout the game was similarly less for the exemplary example putter than the standard putter. That being said, the exemplary example putter comprising an alignment system 50 resulted in fewer putts required for all distances from the hole. As described, lower putts required results in a lower score and, therefore, greater player performance. Therefore, the exemplary example putter comprising an alignment system 50 resulted in greater player performance throughout a round of golf.

10. Example 10

A series of putts were taken by eighteen players was recorded on a 12-hole test course comprising twelve starting positions of varying distances. The players first attempted to make the putt using a standard mallet-style putter comprising a single central line on the crown. The players then attempted to make the putts from the same twelve starting positions, but using an exemplary example putter 190 comprising an alignment system 50 as described further below. The number of putts required to make all twelve holes was recorded and is displayed in Table 3.

The mallet-style putter comprising an exemplary example of an alignment system 50 comprised a central line 60, triangularly dispersed lines 72 arranged symmetrically about and parallel to the central line 60, and a saturation gradient of color along the triangularly dispersed lines 72, as illustrated in FIG. 11. The triangularly dispersed lines focus element 72 comprised an approximately triangular grouping of parallel lines, wherein the apex line was co-located on the central line. Lines of progressively shorter length (measured in a front to rear direction) were symmetrically distributed on either side of the central line 60 forming a heelward portion and a toeward portion, wherein the lines shortened further toeward or further heelward. The lines each comprised a line width equal to or less than the central line width. The triangularly dispersed lines further comprised spaces between the lines having a spacing width equal to the triangular element line width.

The crown comprised a first color 64. The central line 60 comprised a second color 66, distinct from the first color 64. The triangular line elements 72 comprised a third color 68, different from the second color 66 of the central line 60. The triangular line elements 72 were saturated in a visually distinct color from the crown 10 in which the saturation was greatest near the top edge 24 and decreased further from the top edge 24.

Similar to the setup of Example 10, a "short" putt was a stroke less than ten feet from the hole, a "medium" putt was a stroke taken between 10 and 20 feet from the hole, and a "long" putt was a stroke taken greater than 20 feet from the hole. As mentioned prior, the starting position for each of the twelve holes was the same for when the players used both the standard putter and the exemplary example putter. After the first attempted stroke, the distance of the ball from the hole was measured and that putt was categorized into one of these distance groups if the ball did not make it into the hole. These results are displayed in the table below.

TABLE 3

| Total Putts Required for Standard Putter vs. Exemplary Example Putter | | | | | |
|---|---|---|---|---|---|
| | Short putts (<10 ft) | Medium putts (10-20 ft) | Long putts (>20 ft) | Total | Putts/ Round/Person |
| Standard | 183 | 152 | 122 | 457 | 25.38 |
| Exemplary Example | 172 | 140 | 124 | 436 | 24.22 |

Table 3 above illustrates the number of putts required by the group to complete the twelve hole course was overall lower for the exemplary example putter comprising an alignment system 50 in comparison to the standard putter lacking such alignment system. The exemplary example putter resulted in the group of players taking 21 fewer shots throughout the twelve holes. The total number of strokes required by each player overall dropped from 25.38 when using the standard putter to 24.22 when using the exemplary example putter comprising an alignment system 50. This number means the players using the exemplary example putter would, on average, have a lower score of one stroke at twelve holes into a round of golf in comparison to a player using a standard putter without any alignment system.

As mentioned, all other features including weight, mass properties, and dimensions were similar throughout the two clubs. The distinguishing feature between these clubs was that the exemplary example putter further comprised an alignment system on the crown. Therefore, the lower number of putts is reflective of improved player performance due to the exemplary example of an alignment system 50.

CLAUSES

Clause 1. A mallet-style putter-type golf club head having an alignment system wherein the mallet-style putter-type golf club head comprises a front portion having a strike face with a strike face center, a rear portion opposite the front portion; a crown, a sole opposite the crown, a toe portion, a heel portion opposite the toe portion, a top edge defined between the front portion and the crown, and a leading edge defined between the front portion and the sole; wherein an x-axis is defined through the strike face center parallel to a ground plane in a heel-to-toe direction; wherein the sole is oriented approximately parallel to the ground plane when the putter is in an address position; wherein a y-axis is defined through the strike face center perpendicular to the x-axis in a sole-to-crown direction; wherein a z-axis is defined through the strike face center perpendicular to both the x-axis and the y-axis in a front-to-rear direction; wherein a yz-plane is defined by the y-axis and the z-axis; wherein a top edge center point is defined by an intersection of the top edge and the yz-plane; wherein a putter head length is defined as the maximum distance between the strike face and a rear portion rearmost edge measured parallel to the z-axis; wherein a putter head width is defined as the maximum distance between a toe portion most toeward edge and a heel portion most heelward edge measured parallel to the x-axis; wherein a putter head height is defined as the maximum distance between a crown apex and the sole measured perpendicular to the y-axis when the mallet-style putter-type golf club head is in the address position; wherein the mallet-style putter-type golf club head further comprises an alignment system comprising a central line and a plurality of focus elements; wherein the crown comprises a first color; wherein the central line extends rearward from the top edge toward the rear portion from the top edge center point perpendicular to the strike face and parallel to the z-axis; wherein the central line comprises a second color different from the first color; wherein a first focus element comprises a third color different from the first color and the second color; wherein a second focus element is a plurality of lines extending rearward parallel to the central line, each having one end abutting the front edge, and separated into a heelward portion having heelward portion lines and a toeward portion having toeward portion lines; wherein the heelward portion lines and the toeward portion lines are placed heelward and toeward of the central line, respectively; wherein the heelward portion lines comprise a plurality of heelward portion line lengths and the toeward portion lines comprise a plurality of toeward portion line lengths; wherein the heelward portion line lengths and the toeward portion line lengths extend parallel to the z-axis; wherein the heelward portion line lengths decrease as they are distributed further from the central line; and wherein the toeward portion lines have a decreasing length as they are distributed further from the central line.

Clause 2. The mallet-style putter-type golf club head of clause 1, wherein the heelward portion lines and the toeward portion lines each comprise a line directly abutting the central line such that the third color is sharply demarcated from the second color along the length of the lines directly abutting the central line.

Clause 3. The mallet-style putter-type golf club head of clause 1, wherein the heelward portion lines and the toeward portion lines comprise a color saturation; wherein the color saturation is defined as an intensity of the color, wherein a completely saturated area would appear purely a given color and an area with low saturation would fade from the given color into a surrounding color; wherein the heelward portion lines and the toeward portion lines have a highest color saturation adjacent to the front edge and a lowest color saturation furthest from the front edge such that the color saturation decreases from adjacent to the front edge to furthest from the front edge.

Clause 4. The mallet-style putter-type golf club head of clause 1, wherein the central line comprises a central line width and a central line length; wherein the central line width is in a range of 0.05 inch to 0.25 inch; and wherein the central line length is in a range of 0.5 inch to 1.84 inches.

Clause 5. The mallet-style putter-type golf club head of clause 1, wherein the alignment system has an alignment system width measured in a toe portion to heel portion direction; wherein the alignment system width is in a range of 0.5 inch to 2.0 inches; wherein the central line and the focus feature are entirely within the alignment system width.

Clause 6. The mallet-style putter-type golf club head of clause 4, wherein the second focus element is symmetric in a toe portion to heel portion direction about the central line.

Clause 7. The mallet-style putter-type golf club head of clause 5, wherein the second focus element is approximately triangular in shape.

Clause 8. The mallet-style putter-type golf club head of clause 1, wherein the third color is chosen from a set of colors consisting of blue, green, purple, magenta, and gray.

Clause 9. The mallet-style putter-type golf club head of clause 1, wherein at least a portion of the central line further comprises color breaks such that the second color is not visible, and the first color is visible in the color breaks; wherein the at least a portion of the central line has a dashed-line appearance.

Clause 10. The mallet-style putter-type golf club head of clause 1, wherein the focus feature further comprises a third focus element comprising a center dot; wherein the center dot comprises a fourth color; wherein the center dot is placed over the central line directly adjacent to the top edge center point such that the third color is not visible in the center dot; wherein the center dot comprises a central dot length measured parallel to the z-axis and a central dot width parallel to the x-axis; wherein the center dot length is in a range of 0.1 inch to 0.25 inch and the center dot width is in a range of 0.05 inch to 0.25 inch.

Clause 11. A mallet-style putter-type golf club head having an alignment system wherein the mallet-style putter-type golf club head comprises a front portion having a strike face with a strike face center, a rear portion opposite the front portion; a crown, a sole opposite the crown, a toe portion, a heel portion opposite the toe portion, a top edge defined between the front portion and the crown, and a leading edge defined between the front portion and the sole; wherein an x-axis is defined through the strike face center parallel to a ground plane in a heel-to-toe direction; wherein the sole is oriented approximately parallel to the ground plane when the putter is in an address position; wherein a y-axis is defined through the strike face center perpendicular to the x-axis in a sole-to-crown direction; wherein a z-axis is defined through the strike face center perpendicular to both the x-axis and the y-axis in a front-to-rear direction; wherein a yz-plane is defined by the y-axis and the z-axis; wherein a top edge center point is defined by an intersection of the top edge and the yz-plane; wherein a putter head length is defined as the maximum distance between the strike face and a rear portion rearmost edge measured parallel to the z-axis; wherein a putter head width is defined as the maximum distance between a toe portion most toeward edge and a heel portion most heelward edge measured parallel to the x-axis; wherein a putter head height is defined as the maximum distance between a crown apex and the sole measured perpendicular to the y-axis when the mallet-style putter-type golf club head is in the address position; wherein the mallet-style putter-type golf club head further comprises an alignment system comprising a central line and one or more focus elements; wherein the crown comprises a first color; wherein the central line extends rearward from the top edge toward the rear portion from the top edge center point perpendicular to the strike face and parallel to the z-axis; wherein the central line comprises a second color different from the first color; wherein a first focus element comprises at least the second color; wherein the first focus element further comprises two sets of lines extending rearward parallel to the central line and separated into a heelward portion having heelward portion lines and a toeward portion having toeward portion lines; wherein the heelward portion and the toeward portion are placed heelward and toeward of the central line, respectively; wherein the heelward portion lines comprise a plurality of heelward portion line lengths and the toeward portion lines comprise a plurality of toeward portion line lengths; wherein the heelward portion line lengths decrease as they are distributed further from the central line; and wherein the toeward portion lines have a decreasing length as they are distributed further from the central line.

Clause 12. The mallet-style putter-type golf club head of clause 11, wherein the heelward portion lines and the toeward portion lines each comprise a line directly offset from the central line such that the second color along the length of the lines does not directly abut the central line but is separated from the central line by a space comprising the first color.

Clause 13. The mallet-style putter-type golf club head of clause 11, wherein the heelward portion lines and the toeward portion lines comprise a color saturation; wherein the color saturation is defined as an intensity of the color, wherein a completely saturated area would appear purely a given color and an area with low saturation would fade from the given color into a surrounding color; wherein the heelward portion lines and the toeward portion lines have a highest color saturation adjacent to the front edge and a lowest color saturation furthest from the front edge such that the color saturation decreases from adjacent to the front edge to furthest from the front edge.

Clause 14. The mallet-style putter-type golf club head of clause 11, wherein the heelward portion lines and the toeward portion lines each have a line width measured from a toeward to heelward direction parallel to the x-axis, and wherein each line width is the same.

Clause 15. The mallet-style putter-type golf club head of clause 14, wherein the heelward portion lines and the toeward portion lines do not abut one another but are separated from each other by spaces having a space width that is greater than or equal to the line width; and wherein the spaces are the first color.

Clause 16. The mallet-style putter-type golf club head of clause 14, wherein the heelward portion lines and the toeward portion lines do not abut one another, but are separated from each other by spaces having a first space width that is greater than or equal to the line width; wherein the heelward portion lines and the toeward portion lines are further separated into groups such that lines within a group are separated by the first space width, and each group is separated from an adjacent group by a second space width larger than the first space width.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to ocm$^3$ur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Although the invention has been described with reference to specific embodiments, it will be understood by those skilled in the art that various changes may be made without departing from the spirit or scope of the invention. Accordingly, the disclosure of embodiments of the invention is intended to be illustrative of the scope of the invention and is not intended to be limiting.

The invention claimed is:

1. A mallet-style putter-type golf club head, comprising:

a front portion having a strike face, a rear portion opposite the front portion, a crown comprising a first color, a sole opposite the crown, a toe portion, a heel portion opposite the toe portion, a top edge defined between the front portion and the crown and having a top edge centerpoint, and a leading edge defined between the front portion and the sole;

wherein an x-axis is defined through the top edge centerpoint parallel to a ground plane in a heel-to-toe direction;

wherein the sole is oriented approximately parallel to the ground plane when the mallet-style putter-type golf club head is in an address position;

wherein a y-axis is defined through the top edge centerpoint perpendicular to the x-axis in a sole-to-crown direction;

wherein a z-axis is defined through the top edge centerpoint perpendicular to both the x-axis and the y-axis in a front-to-rear direction;

wherein a yz-plane is defined by the y-axis and the z-axis;

wherein the top edge centerpoint is defined by an intersection of the top edge and the yz-plane;

wherein a putter head length is defined as the maximum distance between the strike face and a rear portion rearmost edge measured parallel to the z-axis;

wherein a putter head width is defined as the maximum distance between a toe portion most toeward edge and a heel portion most heelward edge measured parallel to the x-axis;

wherein a putter head height is defined as the maximum distance between a crown apex and the sole measured perpendicular to the y-axis when the mallet-style putter-type golf club head is in the address position;

wherein the mallet-style putter-type golf club head further comprises an alignment system comprising:

a central line;

wherein the central line extends rearward from the top edge toward the rear portion from the top edge centerpoint perpendicular to the strike face and parallel to the z-axis;

wherein the central line comprises a second color different from the first color; and a focus element;

wherein the focus element comprises a first grouping of lines and a second grouping of lines surrounding the first grouping of lines;

wherein the first grouping of lines and the second grouping of lines extend rearward parallel to the central line, each having a base abutting the top edge;

wherein the first grouping of lines comprise the second color;

wherein the second grouping of lines comprise a third color different from the first color and the second color;

wherein the first grouping of lines and the second grouping of lines comprise a color saturation that changes as the first grouping of lines and the second grouping of lines extend rearward from the top edge parallel to the central line;

wherein the first grouping of lines comprise first line lengths and the second grouping of lines comprise second line lengths;

wherein the first line lengths and the second line lengths extend parallel to the z-axis;

wherein the first line lengths and the second line lengths decrease as they are distributed further from the central line;

wherein the color saturation is defined as an intensity of a color, wherein a completely saturated area appears purely a given color and a low saturation area fades from the given color into a surrounding color;

wherein at least one line of the first grouping of lines comprises a completely saturated second color area adjacent to the top edge that gradually transitions to a low saturation second color area as the line extends away from the top edge in a direction parallel to the z-axis;

wherein at least one line of the second grouping of lines comprises a completely saturated third color area adjacent to the low saturation second color area that gradually transitions to a low saturation third color area as the line extends away from the low saturation second color area in a direction parallel to the z-axis.

2. The mallet-style putter-type golf club head of claim 1, wherein each line of the first grouping of lines comprises the completely saturated second color area adjacent to the top edge that gradually transitions to the low saturation second color area as the line extends away from the top edge in the direction parallel to the z-axis;

wherein the second color fades into the third color in the low saturation second color area;

wherein each line of the second grouping of lines comprises the completely saturated third color area adjacent to the low saturation second color area that gradually transitions to the low saturation third color area as the line extends away from the low saturation second color area in the direction parallel to the z-axis;

wherein the third color fades into the first color in the low saturation third color area.

3. The mallet-style putter-type golf club head of claim 1, wherein the central line comprises a central line width;

wherein the central line width is in a range of 0.05 inch to 0.25 inch.

4. The mallet-style putter-type golf club head of claim 1, wherein the alignment system has an alignment system width measured in a toe portion to heel portion direction;

wherein the alignment system width is in a range of 0.5 inch to 2.0 inches;

wherein the central line and the focus element are entirely within the alignment system width.

5. The mallet-style putter-type golf club head of claim 1, wherein the first grouping of lines and the second grouping of lines are symmetric in a toe portion to heel portion direction about the central line.

6. The mallet-style putter-type golf club head of claim 1, wherein the focus element is approximately triangular in shape.

7. The mallet-style putter-type golf club head of claim 1, wherein at least a portion of the central line further comprises color breaks such that the second color is not visible, and the first color is visible in the color breaks;

wherein the at least a portion of the central line has a dashed-line appearance.

8. The mallet-style putter-type golf club head of claim 1, wherein the focus element further comprises a second focus element comprising a center dot;

wherein the center dot comprises a fourth color;

wherein the center dot is placed over the central line directly adjacent to the top edge centerpoint such that the second color is not visible in the center dot;

wherein the center dot comprises a center dot length measured parallel to the z-axis and a center dot width measured parallel to the x-axis;

wherein the center dot length is in a range of 0.1 inch to 0.25 inch and the center dot width is in a range of 0.05 inch to 0.25 inch.

9. The mallet-style putter-type golf club head of claim 1, wherein the first grouping of lines and the second grouping of lines comprise an apex line co-located on the central line.

10. A mallet-style putter-type golf club head, comprising:

a front portion having a strike face, a rear portion opposite the front portion; a crown comprising a first color, a sole opposite the crown, a toe portion, a heel portion opposite the toe portion, a top edge defined between the front portion and the crown and having a top edge centerpoint and a leading edge defined between the front portion and the sole;

wherein an x-axis is defined through the top edge centerpoint parallel to a ground plane in a heel-to-toe direction;

wherein the sole is oriented approximately parallel to the ground plane when the mallet-style putter-type golf club head is in an address position;

wherein a y-axis is defined through the top edge centerpoint perpendicular to the x-axis in a sole-to-crown direction;

wherein a z-axis is defined through the top edge centerpoint perpendicular to both the x-axis and the y-axis in a front-to-rear direction;

wherein a yz-plane is defined by the y-axis and the z-axis;

wherein the top edge centerpoint is defined by an intersection of the top edge and the yz-plane;

wherein a putter head length is defined as the maximum distance between the strike face and a rear portion rearmost edge measured parallel to the z-axis;

wherein a putter head width is defined as the maximum distance between a toe portion most toeward edge and a heel portion most heelward edge measured parallel to the x-axis;

wherein a putter head height is defined as the maximum distance between a crown apex and the sole measured perpendicular to the y-axis when the mallet-style putter-type golf club head is in the address position;

wherein the mallet-style putter-type golf club head further comprises an alignment system comprising:

a central line;

wherein the central line extends rearward from the top edge toward the rear portion from the top edge centerpoint perpendicular to the strike face and parallel to the z-axis;

wherein the central line comprises a second color different from the first color; and a focus element;

wherein the focus element comprises at least the second color;

wherein the focus element further comprises two sets of lines extending rearward parallel to the central line and separated into heelward portion lines and a toeward portion having toeward portion lines, each having a base abutting the top edge;

wherein the heelward portion lines and the toeward portion lines are placed heelward and toeward of the central line, respectively;

wherein the heelward portion lines and the toeward portion lines comprise a color saturation that changes as the heelward portion lines and the toeward portion lines extend rearward from the top edge parallel to the central line;

wherein the heelward portion lines comprise a plurality of heelward portion line lengths and the toeward portion lines comprise a plurality of toeward portion line lengths;

wherein the heelward portion line lengths decrease as they are distributed further from the central line; and wherein the toeward portion line lengths decrease as they are distributed further from the central line;

wherein the color saturation is defined as an intensity of a color, wherein a completely saturated area appears purely a given color and an area with low saturation fades from the given color into a surrounding color;

wherein at least one line of the focus element comprises a completely saturated second color area adjacent to the top edge that gradually transitions to a low saturation second color area as the line extends away from the top edge in a direction parallel to the z-axis.

11. The mallet-style putter-type golf club head of claim 10, wherein the heelward portion lines and the toeward portion lines each comprise a line directly offset from the central line such that the second color along the length of the lines does not directly abut the central line but is separated from the central line by a space comprising the first color.

12. The mallet-style putter-type golf club head of claim 10, wherein each line of the focus element comprises the completely saturated second color area adjacent to the top edge that gradually transitions to the low saturation second color area as the line extends away from the top edge in the direction parallel to the z-axis;

wherein the second color fades into the surrounding color in the low saturation second color area.

13. The mallet-style putter-type golf club head of claim 10, wherein each line of the heelward portion lines and the toeward portion lines has a line width measured from a toeward to heelward direction parallel to the x-axis, and wherein the line width of each line of the heelward portion lines and the toeward portion lines is the same.

14. The mallet-style putter-type golf club head of claim 13, wherein each line within the set of heelward portion lines and each line within the set of toeward portion lines do not abut one another, but are separated from each other by spaces having a first space width that is greater than or equal to the line width; and wherein the spaces are the first color.

15. The mallet-style putter-type golf club head of claim 14, wherein the set of heelward portion lines and the set of toeward portion lines are separated by a second space width larger than the first space width.

* * * * *